US006893342B1

(12) United States Patent
Singer et al.

(10) Patent No.: US 6,893,342 B1
(45) Date of Patent: May 17, 2005

(54) SLOT MACHINE GAME HAVING A PLURALITY OF WAYS FOR A USER TO INTUITIVELY OBTAIN PAYOUTS

(75) Inventors: Anthony M. Singer, Ringwood, NJ (US); Howard M. Marks, Westport, CT (US); Daniel Marks, Brooklyn, NJ (US)

(73) Assignee: PTT, LLC, White Plains, NY (US)

( * ) Notice: Subject to any disclaimer, the term of this patent is extended or adjusted under 35 U.S.C. 154(b) by 227 days.

(21) Appl. No.: 09/794,083

(22) Filed: Feb. 28, 2001

Related U.S. Application Data

(63) Continuation-in-part of application No. 09/563,293, filed on May 3, 2000, now abandoned.
(60) Provisional application No. 60/132,191, filed on May 3, 1999.

(51) Int. Cl.[7] ..... A63F 9/24
(52) U.S. Cl. ..... 463/20; 273/143 R
(58) Field of Search ..... 463/1, 16–18, 463/20–22, 25–28, 30–31, 37, 43–44; 273/138.1, 138.2, 139, 142 B, 142 R, 143 A, 143 R

(56) References Cited

U.S. PATENT DOCUMENTS 4,695,053 A * 9/1987 Vazquez et al. ..... 463/18
5,163,131 A 11/1992 Row et al.
5,580,053 A 12/1996 Crouch
6,093,102 A * 7/2000 Bennett ..... 463/20
6,159,098 A * 12/2000 Slomiany et al. ..... 463/25
6,231,442 B1 * 5/2001 Mayeroff ..... 463/20

OTHER PUBLICATIONS

Boxer, Aaron. "Where Buses Cannot Go." *IEEE Spectrum*, Feb. 1995, pp. 41–45.

Barroso, Luiz André, Sadan Iman, Jaeheon Jeong, Koray Öner and Michel Dubois. "RPM: A Rapid Prototyping Engine for Multiprocessor Systems." *IEEE Computer*, Feb. 1995, pp. 26–34.

* cited by examiner

*Primary Examiner*—Kim Nguyen
(74) *Attorney, Agent, or Firm*—Irah H. Donner; Wilmer Cutler Pickering Hale and Dorr LLP

(57) ABSTRACT

A slot machine-like game-of-chance system and method that rewards players for winning combinations of symbols when at least one symbol appears within an area of the display selected by the player. A player may select a display domain such as one or more of the columns, and receive a reward if a first predetermined symbol appears within the display domain. The player can also be awarded if a second predetermined symbol also appears in the display. The player may also receive a first random bonus payout independent of the display domain selected by the player, and the opportunity to win a second bonus payout dependent upon a player choice made prior to receiving the first random bonus payout.

18 Claims, 37 Drawing Sheets

SLOT MACHINE GAME HAVING A PLURALITY OF WAYS FOR A USER TO INTUITIVELY OBTAIN PAYOUTS

RELATED APPLICATIONS

This application claims priority to, and is a continuation-in-part of U.S. application Ser. No. 09/563,293, filed May 3, 2000, now abandoned, which in turn claims priority to application Ser. No. 60/132,191, filed May 3, 1999, and both incorporated herein by reference.

BACKGROUND OF THE INVENTION

1. Field of the Invention

The present invention relates generally to payout methods in a mechanical, an electro-mechanical and/or computer-based slot machine-like game-of-chance and, more particularly, to a method, an apparatus, and a computer readable medium storing computer-executable instructions for enabling a player to intuitively select one or more display domains such as one or more spin positions, one or more spin domains, one or more columns, one or more rows, and/or one or more symbols, and optionally in conjunction with another conditional probability, such as another symbol free of position and/or another symbol position dependent. The present invention optionally further provides the player the capability to receive bonus credits dependent upon or independent of any player-selected payline(s), combination of symbols, symbols and/or spin positions. Optionally, the present invention also relates to the ability for the display domain to be selected by other means, such as by the game system or via a predetermined selection.

2. Background Description

Games-of-chance, such as slot machines, typically define subsets of the matrix of symbol positions as valid pay lines. For example, standard slot machines having a play area of three horizontal rows (that define a top line, a centerline, and bottom line) and three vertical columns generally define the three positions of the centerline as a pay line. If a spin results in all the symbols on that payline being the same or equivalent (e.g., a "wild card" can be used as an equivalent with, say, two other matching symbols), then the slot will lookup that symbol set in the slot's payoff table and award the player the credits indicated.

As shown in FIG. 1, U.S. Pat. No. 5,580,053 to Crouch, entitled Multi-Line Gaming Machine, discloses a gaming machine 50 that has a display 51 on which an array of symbols is displayed. The array is typically 3 rows×5 columns. During a game the symbols displayed on the array are caused to change with a random result being obtained. The player of the machine makes a wager on the result and is paid a prize if one of a number of predetermined combinations of symbols are displayed on a line of the display 51 at the end of the game. The player may make multiple wagers on each game with each wager being assigned to a different one of a plurality of possible result lines. Typically, the number of possible result lines is greater than or equal to 9, and the lines to be employed in each game are selected by switches 54, prior to a game being initiated.

FIG. 2, as disclosed in U.S. Pat. No. 5,580,053, shows a 3×5 display 51 having 12 paylines, indicated by numerals 1 to 12 on the Figure. FIG. 3, as disclosed in U.S. Pat. No. 5,580,053, shows a 3×5 display 51 having 27 paylines, indicated by numerals 1 to 27 on the Figure. U.S. Pat. No. 5,580,053 also states that machines having a 3×3 or 3×4 display size.

Presently, however, slot machines do not provide players with, for example, a standard 3×3 display (i.e., three horizontal rows and three vertical columns) or an expanded display area (e.g., three horizontal rows and five vertical columns), wherein the player can select a display domain within the display area such that the combination of the player-selected display domain, such as a domain or area on the display with a coincidence of a predetermined symbol within the selected display domain determine one or more potential payouts to the player.

Because of these limitations, slot machines presently do not enable players to intuitively guess and/or select, or reward players for intuitively guessing and/or selecting, one or more display domains. Finally, present slot machines do not award bonus credits, independent of any player-selected paylines and/or spin position when, for example, two or more predefined symbols appear anywhere within the display area. Therefore, there is a need for a system and method that advantageously provides players with an enhanced slot machine-like game-of-chance that overcomes these limitations.

SUMMARY OF THE INVENTION

It is a feature and advantage of the present invention to allow players to select one or more selected display domains, such as player selected, associated with one or more predetermined or pre-specified symbols that appear within the display area to determine an award, optionally in conjunction with another conditional probability such as a predetermined symbol appearing on the display area position free and/or position dependent. A display domain, as defined herein, includes, for example, one or more spin positions, one or more spin domains, one or more columns, one or more rows, and/or one or more symbols.

It is another feature and advantage of the present invention to enable players to receive a predetermined payout based on the combination of symbols that appear within at least a portion of the selected display domain, such as a player selected display domain.

It is yet another feature and advantage of the present invention to enable players to receive a random payout based on the combination of symbols that appear within at least a portion of the display domain or other display area, wherein the random payouts average out to a predetermined value.

It is still another feature and advantage of the present invention to enable players to select a spin position and/or symbol that optionally provides a potential payout associated with the spin position or symbol.

It is still another feature and advantage of the present invention to award bonus credits, independent of any player-selected display domain and/or spin position.

In an exemplary embodiment, the intuitive pays aspect of the present invention allows a player select, for example, at least one of a display domain, a symbol, a column, a row, a payline and/or a position before the spin.

For example, a slot machine may have, for example, three spin buttons: 1 blue, 1 yellow and 1 red. When the player presses one of these colored spin buttons the slot reels turn and eventually stop. The final spin results of pressing any of the 3 buttons are identical, and the only reason for offering a choice is that a subset of the final symbol set is associated with one of the 3 buttons. That is, selection of one of the buttons selects a symbol or column associated with the button. An additional award is provided when one or more predetermined symbols or combination of symbols, appears all or at least partially within the selected column, row or position, and optionally in conjunction with another conditional probability, such as a symbol appearing within the display area position independent and/or position dependent.

For example, Reel 1 may be associated with a blue button, Reel 3 is associated with a yellow button and Reel 5 is associated with a red button. Since Reels 2 and 4 do not have an associated button, no additional award is provided if a predetermined symbol or group of symbols appear in column 2 and 4 unless the symbols appear in the selected column, and optionally in combination with one or more other symbols appearing in one or more other columns. When the player presses the red spin button, the player hopes that the special pay symbol (e.g., a diamond), will appear on Reel 5. The choice is clearly just intuitive, that is, there is no knowledge or skill involved, yet the player feels that his fate is in his hands.

Note that for this concept to work it is not necessary for there to be 3 separate spin buttons. An alternative representation would have the three reels light up one at a time, in sequence and for the player to simply choose his preferred reel by pressing the spin button at the appropriate time. Rather, the important part of the present invention is provide the player the ability to select at least one of a display area, such as a display area, a row, a column, a specific position, a specific symbol, a pay line, and the like. Further, any number of reels may also be used with any number of symbols in a column.

Further, it is not necessary that actual wheels spin like a slot machine. Rather, this enhanced payout which is determined or selected by the player at the beginning of play may also apply to card games based on a predetermined set of cards in the resulting dealer and/or specific player hand. For example, one player or dealer may be designated as the card hand to view at the end of play for the predetermined card or cards in a specific hand. Further challenge games, including video challenge games, where the result is not based on player actions that may result in collusion also apply.

In accordance with another embodiment of the invention, implemented by the software appendix attached hereto and basic process illustrated in FIGS. 4*a*–4*c*, the user has the opportunity to press one of three spin buttons with a corresponding diver having helmet in hand directly above the column. Similar mechanisms or alternatives apply where the diver is positioned in a single location anywhere on or near the reel display or where the diver is positioned above the spin buttons.

When a pearl appears in a selected column by the player and, for example, a WILD symbol with helmet, the conditional probability, appears anywhere on the display, the additional award is provided to the player. In this situation, the diver above the selected column dives down on the display and grabs the pearl in a symbolic fashion as finding a treasure, thereby enhancing the excitement to the player.

In FIG. 4*b*, an additional bonus is provided as yet a further level where a combination of predetermined symbols (e.g., three golden oysters) appear on the display. In this additional bonus a new bonus screen is displayed with three divers on three islands, the player selects one of the divers of the three, and a diving competition then begins between the players diver and the remaining two divers. The divers then uncover the five smaller clams, each clam having a specific number of points underneath. The diver with the most points then wins the competition. If it is the player's diver that wins, the player is provided with an option of or the opportunity to uncover the large clam beneath all the smaller clams for an even greater bonus.

The diving competition may take various forms of different types of competitions, and is not limited to diving. For example, different competitions for collecting items, or other competitions which allow the player to collect points, or alternatively obtain the lowest score (e.g., a golf type competition), are within the scope of the diving competition of the present invention.

FIG. 4*c* is an illustration of a further bonus round of the present invention where the player has the further option of selecting a treasure chest for an additional bonus, an additional bonus screen in provided as yet a further level where a combination of predetermined symbols (e.g., three treasure chests) appear on the display. This specific bonus is implemented in accordance with the software attached hereto, and may also be altered for other type of items that may be selected for an additional bonus.

The present invention, in any of the above embodiments or embodiments described below, is not limited to where the bonus is awarded when the WILD appears anywhere on the screen and the pearl appears in the selected column. For example, the present invention may alternatively be implemented when the pearl or other symbol appears in the same column as the WILD, or in any predetermined relationship with respect to each other, or where the pair of symbols appear anywhere on the display, or where the player need not select a specific column where at least one of the symbols must appear. Alternatively, the present invention may use or utilize more than a pair of symbols, such as a combination of three symbols, four symbols, five symbols, and the like.

Further, the present invention also applies to numbers such as number cards, where numbers are treated similarly as symbols. For example, the present invention may provide a bonus when the player obtains a predetermined pair or other combination. For example, a joker may be used as a WILD which, when in combination with another or specific card, optionally based on a specific column selected by the player, will provide a bonus. Other variations using numbered cards are also considered alternatives of the present invention in all of the embodiments described herein.

In yet a third embodiment, a slot machine has an associated payout table that declares the exact payout for any particular combination of symbols that are involved in the main game. This embodiment describes a method of payment to a slot machine player that relies on average-random-payouts. That is, when certain symbols or symbol combinations appear, the player can be rewarded from a range of payouts which average out to a particular expected value. The essential ingredient is that these average-random payouts occur within the normal spinning of the reels, as opposed to during a secondary bonus event.

For example, a slot machine has two special payout symbols (e.g., a gold mine and a lantern). If these symbols both occur within a column then a golden nugget is displayed in the entrance to the gold mine. Its value is random and constrained to be of a specific average value. This method of payout adds excitement for the player and still allows for controlled payback percentages.

| Nugget Payout | Random Probability | Weighted Payout |
|---|---|---|
| 10 | 40% | 4 |
| 20 | 20% | 4 |
| 30 | 15% | 4.5 |
| 50 | 15% | 7.5 |
| 100 | 10% | 10 |
| | Total | 30 |
| | Average | 6 |

The present invention, in any of the above embodiments is not limited to where the bonus is awarded when the nugget appears with the lantern in the selected column. For example, the present invention may alternatively be implemented when the gold nugget or other symbol appears in any predetermined relationship with respect to the lantern or other symbol, or where the pair of symbols appear anywhere on the display, or where the player need not select a specific column where at least one of the symbols must appear. Alternatively, the present invention may use or utilize more than a pair of symbols, such as a combination of three symbols, four symbols, five symbols, and the like.

Further, the present invention also applies to numbers much as number cards, where numbers are treated similarly as symbols. For example, the present invention may provide a bonus when the player obtains a predetermined number combination in a specific pattern in a similar manner as a slot machine. For example, a joker may be used as a WILD which, when in combination with another or specific card, optionally based on a specific column selected by the player, will provide a bonus. Other variations using numbered cards are also considered alternatives of the present invention in all of the embodiments described herein.

To achieve the above and address other problems of the prior art, the present invention provides an improved and novel method, system, and computer readable medium storing computer executable instructions for playing a slot machine-like game-of-chance. The game awards the player based both on his intuitive choice of display domain such as a display area and/or spin position, and randomly (i.e., independent of the player-selected display domain and/or spin position) when, for example, the appearance of two or more predefined symbols anywhere within the display area.

In a preferred embodiment, the method includes the steps of having a player select at least one display domain associated with a display of a plurality of symbols of a real or simulated slot machine-like spin operation or turn. The player selects as a display domain, for example, a spin position by choosing, for example, one of a plurality of spin buttons associated with respective spin reels. Once the player selects his spin position, a spin operation is performed that rearranges the symbols, preferably in a random manner. After rearrangement, the symbols eventually stop. As the reels stop spinning, it is preferred that, for a 5 reel display, the leftmost reel, for example, stops first, then the $2^{nd}$ reel stops, then the $3^{rd}$, then the $4^{th}$, and finally the $5^{th}$ or rightmost reel stops last. The player can thus "naturally" follow the unfolding excitement of a win. Of course, any other reel-stopping sequence may also be used.

The results of the spin operation are displayed and, depending on the displayed symbols, the player is awarded when two or more predetermined symbols or combination of symbols appears within any of the selected paylines.

In the preferred embodiment, an optional bonus award is provided. For this optional bonus award, a payline for a 5 reel display comprises five contiguous symbols, either linearly or diagonally. A bonus payout may occur when as few a two contiguous symbols appear within a payline, and as many as five contiguous symbols appear within a payline. Thus, the player may wish to choose a particular payline or combination of paylines because he feels that the selected payline or combination of paylines will maximize his payout/return for the bonus award. The choice is clearly intuitive. That is, regardless of which payline or paylines is/are selected, the final spin result provided in the display area is the same. The reason for offering a choice paylines is to enable the player to select the payline or paylines he feels will maximize his return/payout. There is no a priori knowledge or skill involved. In another embodiment of the invention, the payline bonus award is randomly selected by the player.

The method according to the present invention thus eliminates the traditional, limited, fixed paylines and allows the player to optionally collect a bonus award along any player-selected payline(s) when any of two or more predetermined symbols appear contiguously along a payline. This new concept may be utilized on any form of slot machine from traditional 3-reel stepper slots to the newest generation of video slot machines, including any number of reels and/or any number of symbols. However, at least five reels are preferred in order to provide the player with paylines that comprise five symbols, which provide enhanced payout possibilities over standard three symbol payout lines, as will be described in further detail herein.

As described above, the intuitive aspect of the present invention also applies to the player being awarded when, for example, a first predetermined symbol (e.g., a clam) appears within a reel below the selected display domain, and a second predetermined symbol also appears on the display. Thus, the player may wish to choose a particular display domain because he feels that the predetermined symbol will appear within the column below this position. The choice is again clearly intuitive. That is, regardless of which spin position is selected, the final spin result provided in the display area is the same.

The reason for offering a choice of display domain, such as spin position, is to enable the player to select the spin position he feels that the predetermined symbol will appear under. In an alternate embodiment of the spin position, each spin position may be represented by a different symbol that appears at the top of the column associated with the selected spin position, where the player selects the symbol (i.e., spin position) that he feels will have the most appearances within the display and/or award him with the most credits.

An exemplary embodiment of the present invention further includes bonus payouts that occur, for example, when two or more of the same predetermined symbols (e.g., treasure chests, golden claim, etc.) appear anywhere within the display. For example, if two of the same predetermined symbols (e.g., treasure chests) appear anywhere on the display, the player may be presented with a new display where he can, for example, select between three sunken treasure chests, each of which have bonus credits associated therewith.

If, for example, three of the same predetermined symbols (e.g., treasure chests, golden clams, etc.) appear anywhere on the screen, three divers, for example, may be presented on another display, each of which dive for a predetermined number of pearls having bonus credits associated therewith.

The player intuitively selects one of the three divers and if the player-selected diver accumulates the most credits, the diver can make an additional dive and earn additional bonus credits. That is, if the player selects the highest payout among a plurality of payouts, he also earns an additional bonus payout.

Note that this aspect of the game links the random and intuitive concepts. That is, the initial screen presenting the three divers occurs purely by chance. It has nothing to do with and is completely independent of any selection by the player of paylines and/or spin positions. However, once the three divers appear, the player intuitively selects the diver that he feels will win the most credits and, if the player is correct, can obtain additional credits. It is preferred that the for each additional round of the game that the player does not correctly select the diver who wins the most credits, the more credits he will win when he eventually does select the diver who wins the most credits.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other systems and methods for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The Detailed Description including the description of a preferred structure as embodying features of the invention will be best understood when read in reference to the accompanying figures wherein.

The same reference numerals refer to the same parts through the various figures.

Notations and Nomenclature

Figure 1:
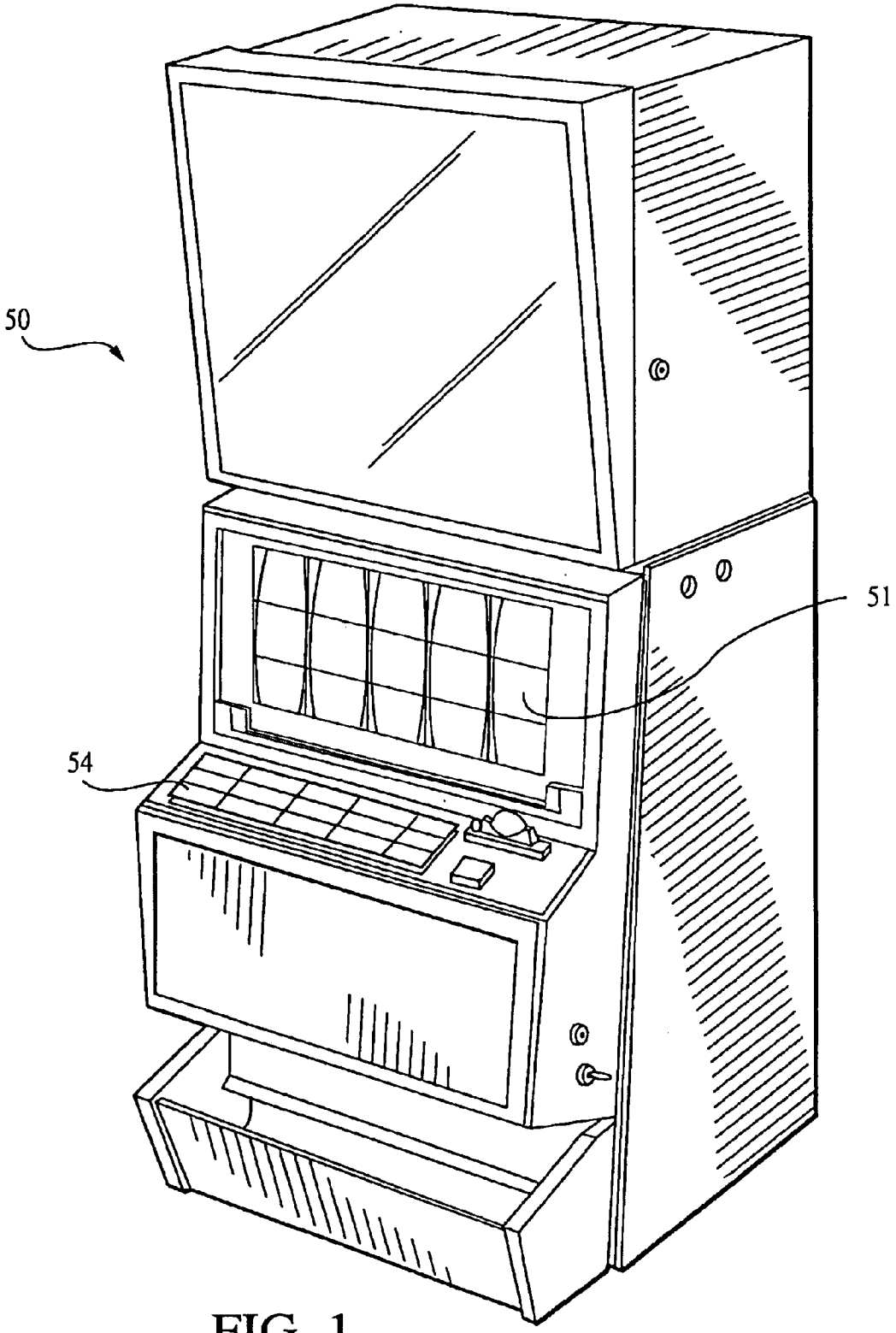
FIG. 1 PRIOR ART
FIG. 1 illustrates a prior art slot machine.
Figure 2:
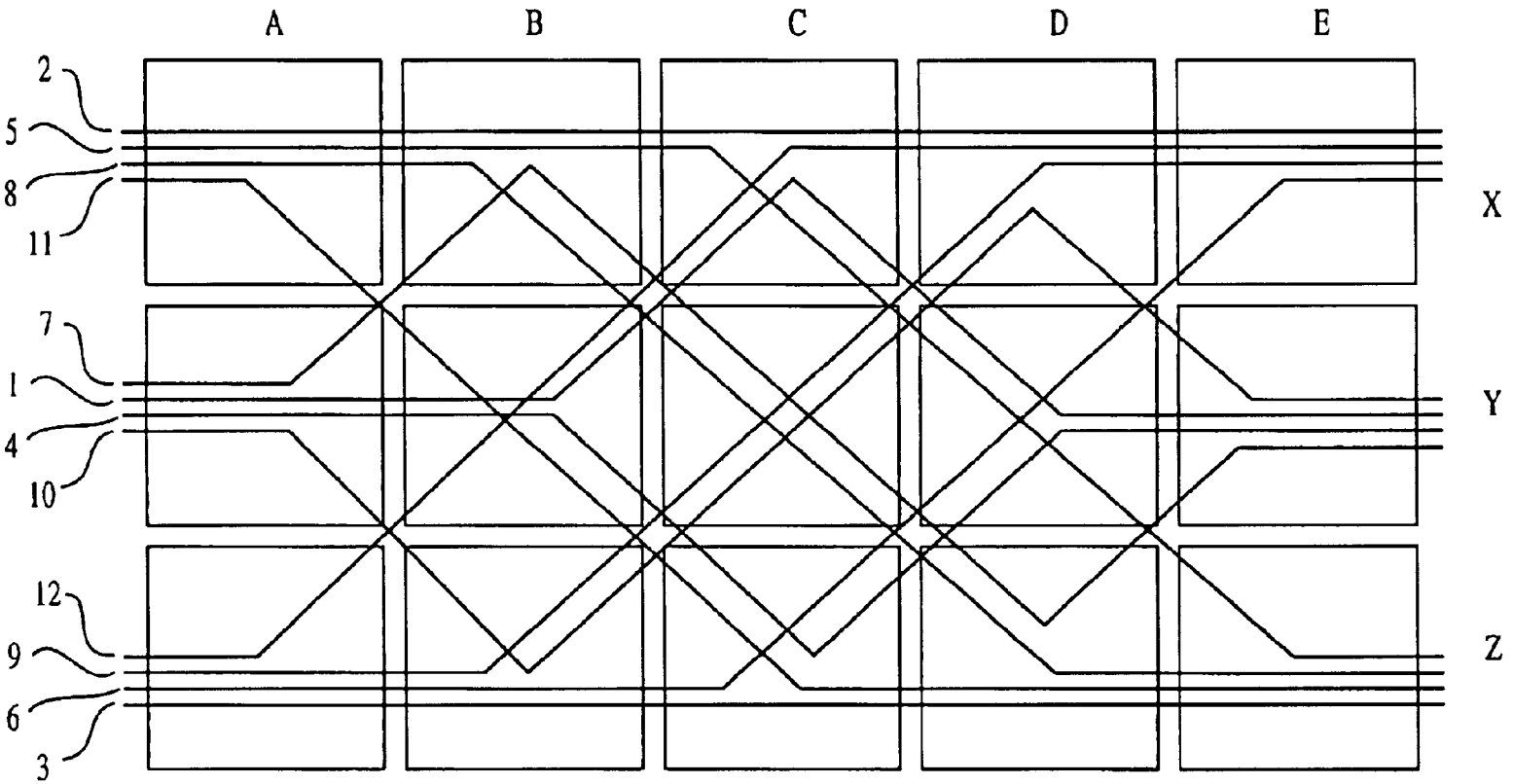
FIG. 2 PRIOR ART
FIG. 2 diagramatically illustrates a prior art 12 line multi-line pay arrangement for a machine with a 3×5 display format.
Figure 3:
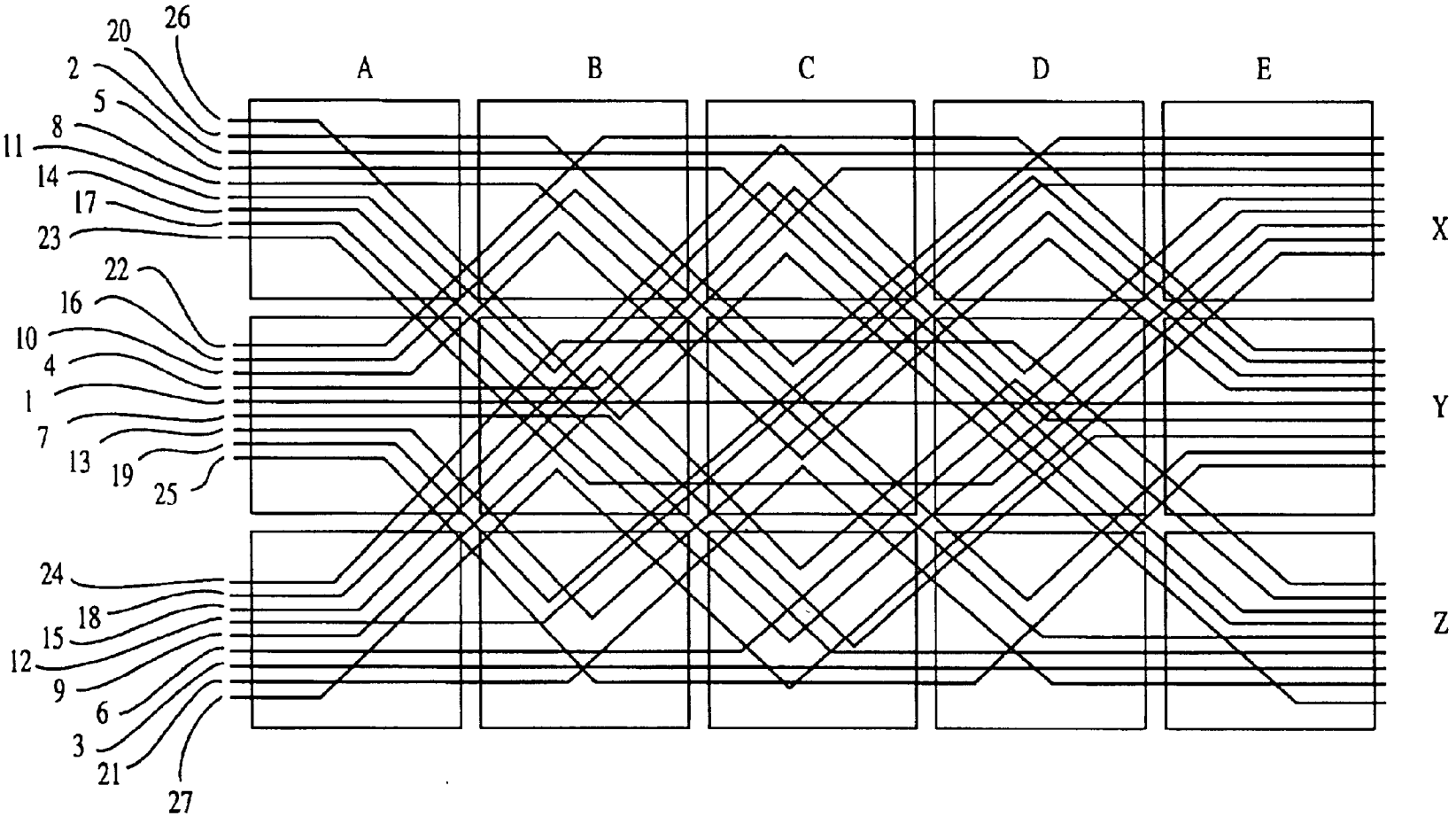
FIG. 3 PRIOR ART
FIG. 3 diagrammatically illustrates a prior art 27 line multi-line pay arrangement for a machine with a 3.times.5 display format.
Figure 4A:
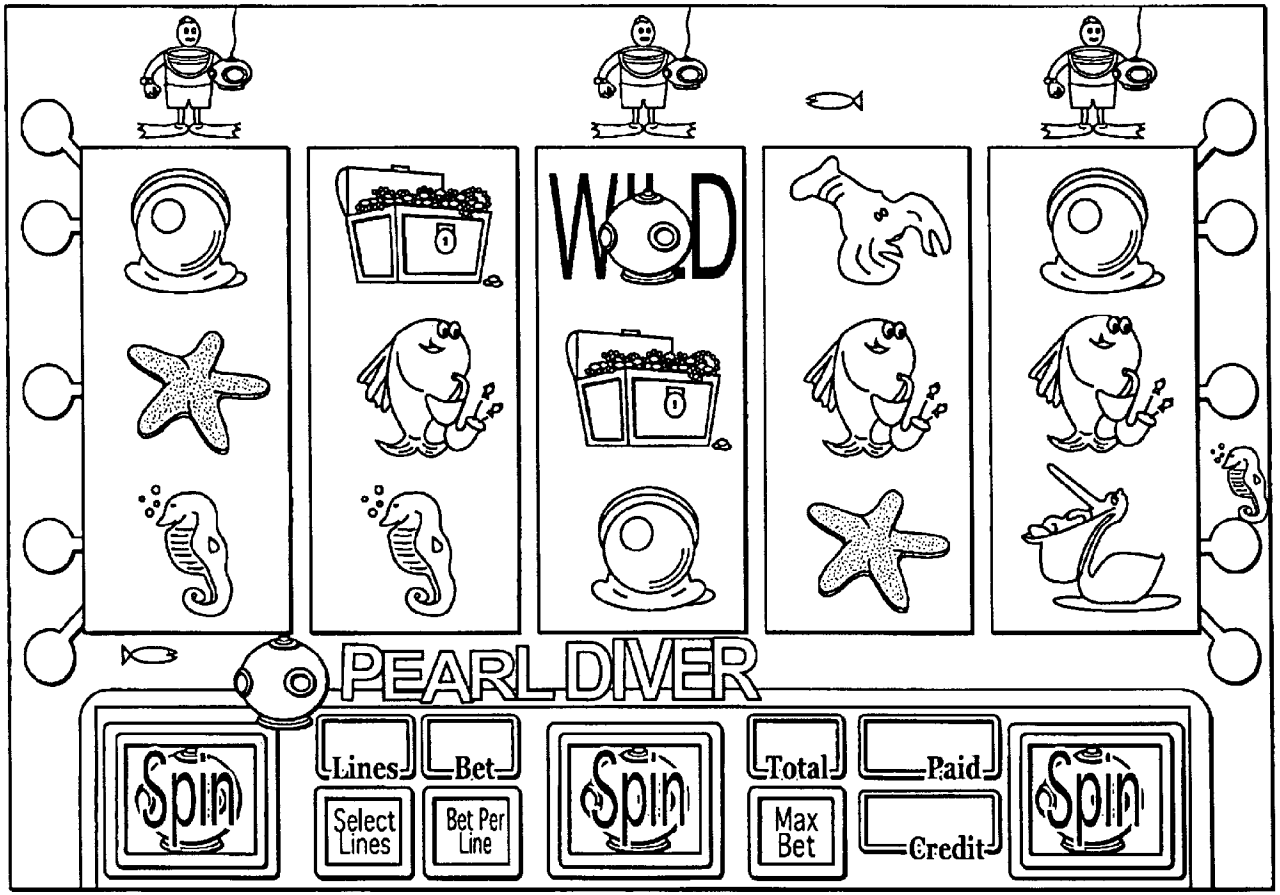
FIGS. 4*a*–4*c* show an illustrative example of representative displays that may be encountered during a typical game in accordance with the principles of the present invention FIGS. 5*a*–5*b*, taken together, is a flowchart depicting a preferred embodiment of the present invention.
Figure 4B:
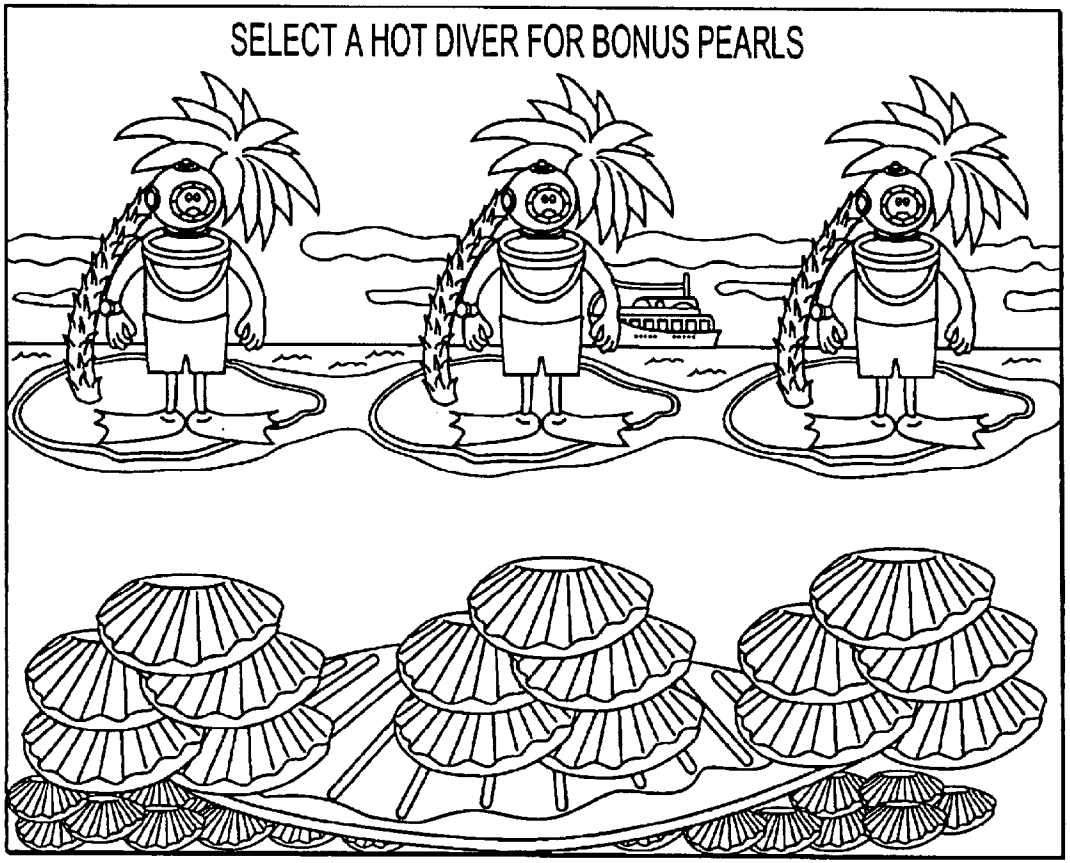
Figure 4C:
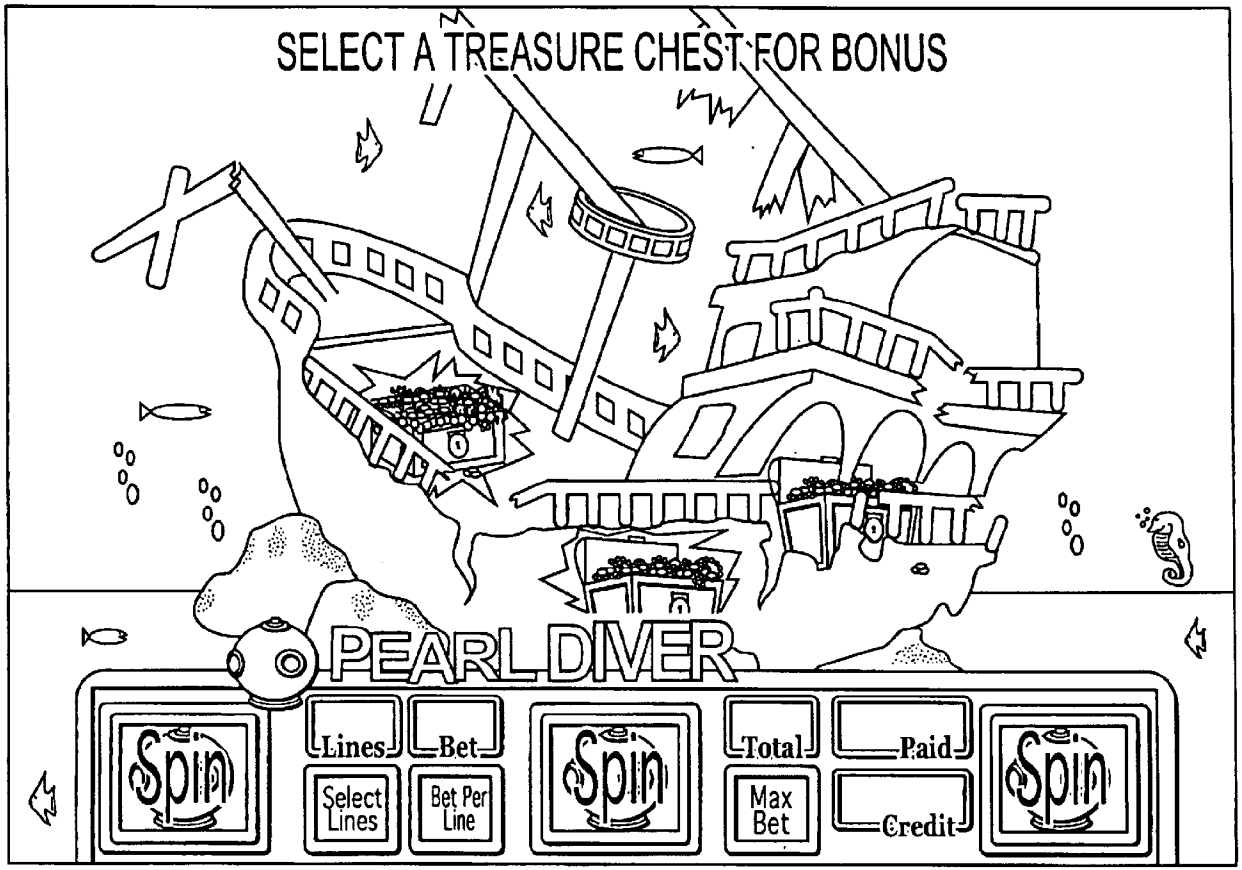

The detailed descriptions which follow may be presented in terms of program procedures executed on a computer or network of computers. These procedural descriptions and representations are the means used by those skilled in the art to most effectively convey the substance of their work to others skilled in the art.

A procedure is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations described herein which form part of the present invention; the operations are machine operations. Useful machines for performing the operation of the present invention include general purpose digital computers or similar devices.

The present invention also relates to apparatus for performing these operations. This apparatus may be specially constructed for the required purpose or it may comprise a general purpose computer as selectively activated or reconfigured by a computer program stored in the computer. The procedures presented herein are not inherently related to a particular computer or other apparatus. Various general purpose machines may be used with programs written in accordance with the teachings herein, or it may prove more convenient to construct more specialized apparatus to perform the required method steps. The required structure for a variety of these machines will appear from the description given.

DETAILED DESCRIPTION OF A PREFERRED EMBODIMENT OF THE INVENTION

Reference now will be made in detail to the presently preferred embodiments of the invention. Such embodiments are provided by way of explanation of the invention, which is not intended to be limited thereto. In fact, those of ordinary skill in the art may appreciate upon reading the present specification and viewing the present drawings that various modifications and variations can be made.

For example, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

The present invention provides players the capability to select one or more selected display domains, such as player selected, associated with one or more predetermined or pre-specified symbols that appear within the display area to determine an award, optionally in conjunction with another conditional probability such as a predetermined symbol appearing on the display area position free and/or position dependent. A display domain, as defined herein, includes, for example, one or more spin positions, one or more spin domains, one or more columns, one or more rows, and/or one or more symbols.

In accordance with one embodiment of the invention, a slot machine-like game-of-chance is disclosed that enables a player to intuitively select one or more display domains, such as at least one spin position and/or symbol within the game display area, and optionally receive bonus credits dependent upon or independent of any player-selected display domains and/or spin position. The present invention can be best understood by first considering a preferred symbol set used in the preferred embodiment.

Symbol Set Used in the Preferred Embodiment

A video slot machine, entitled Pearl Diver™ as disclosed in the preferred embodiment herein, displays a screen with 3-rows and 5-columns (i.e., reels), and preferably utilizes a symbol set as described hereinbelow.

In an exemplary embodiment, the intuitive pays aspect of the Pearl Diver™ embodiment allows a player to select, for example, one of three spin buttons with a corresponding diver having helmet in hand directly above the column. Similar mechanisms or alternatives apply where the diver is positioned in a single location anywhere on or near the reel display or where the diver is positioned above the spin buttons.

When a pearl appears in a selected column by the player and, for example, a WILD symbol with helmet appears anywhere on the display, the additional award is provided to the player. In this situation, the diver above the selected column dives down on the display and grabs the pearl in a symbolic fashion as finding a treasure, thereby enhancing the excitement to the player.

An additional bonus is provided as yet a further level where a combination of predetermined symbols (e.g., three golden oysters) appear on the display. In this additional bonus a new bonus screen is displayed with three divers on three islands, the player selects one of the divers of the three, and a diving competition then begins between the players diver and the remaining two divers. The divers then uncover the five smaller clams, each clam having a specific number of points underneath. The diver with the most points then wins the competition. If it is the player's diver that wins, the player is provided with an option of or the opportunity to uncover the large clam beneath all the smaller clams for an even greater bonus, an additional bonus screen is provided as yet a further level where a combination of predetermined symbols (e.g., three treasure chests) appear on the display.

A further bonus round of the present invention provides the player a further option of selecting a treasure chest for an additional bonus. This specific bonus is implemented in accordance with the software attached hereto, and may also be altered for other type of items that may be selected for an additional bonus.

It should be understood that screen displays having other then 3-rows and 5-columns, and pay symbols other than those listed below, can equally be utilized. For example, a standard 3×3 display could be utilized. Also, in general, an expanded display area can be of the size of a $(3+n)\times(5+2n)$ matrix, where $(3+n)$ defines the number of rows of the matrix, $(5+2n)$ defines the number of columns of the matrix, and where $n=0, 1, 2, \ldots, \infty$. Other display areas can also be used.

It should also be understood that the present invention may take various forms as different types of competitions or bonus games, and is not limited to diving as described in the preferred embodiment. For example, different competitions for collecting items, or other competitions which allow the player to collect credits (e.g., card games), or alternatively obtain the lowest score (e.g., a golf type competition), are within the scope of the diving competition of the present invention. In the context of card games, the payout methods according to the present invention may be based on, for example, a predetermined set of cards in the resulting dealer and/or specific player hand. One player or dealer may be designated as the card hand to view at the end of play for the predetermined card or cards in a specific hand. Further, the present invention also applies to numbers such as number cards, where numbers are treated similarly as symbols. For example, the present invention may provide a bonus when the player obtains a predetermined pair or cards or other combination. A joker may be used as a WILD which, when in combination with another or specific card, optionally based on a specific column selected by the player, will provide a bonus. Other variations using numbered cards are also considered alternatives of the present invention in all of the embodiments described herein. Further challenge or bonus games, including video challenge games, where the result is not based on player actions that may result in collusion also apply.

The following is a generalized description of the basic elements used in the present invention in accordance with one embodiment. Various laternatives may also be incorporated, as described herein, and as are within the scope of the present invention.

Pay Symbols A stylized set of sea creature themed symbols, such as: a fish, a saxophone-playing fish, a starfish, a seahorse, a lobster, a seagull, a clam containing a golden pearl, a clam containing a black pearl, a clam containing a purple pearl, etc., are used to reward the player according to a fixed payout schedule. Other themes or designs may alternatively be used.

Wild Symbol An optional wild symbol, such as diver's helmet, is used as an equivalent for any pay symbol to create a winning combination. The wild symbol is also used in conjunction with spin position payouts, wherein a clam appears under a player-selected spin position and with wild symbol also appears anywhere else within the display.

Scatter Pay When three predetermined scatter pay Symbol symbols (e.g., a treasure chest, etc.) appear anywhere within the display, the player is provided an option of selecting, for example, one of three treasure chests, each having bonus credits associated therewith. When three predetermined scatter pay symbols, (e.g., three golden oysters), appear anywhere within the display, the player is provided, for example, an option of selecting one of three divers who retrieve bonus pearls. If the player selects the diver who has the highest credit award associated with the collected pearls, the player can dive for a Golden Pearl and receive additional bonus credits. That is, if the player selects the highest payout among a plurality of payouts, he also earns an additional bonus payout.

Intuitive Pays—Example

As discussed above, in one embodiment of the invention, intuitive play involves providing the player the capability of selecting a display domain or area, such as a spin and/or symbol position. Here, the player may be awarded, when, for example, a first predetermined symbol and optionally pre-selected symbol (e.g., a pearl) appears within a reel below the player-selected spin position, and a second predetermined symbol and optionally pre-selected symbol also appears on the display. As is the case with the player-selected paylines, the player may similarly wish to choose a particular spin position and/or symbol because he feels that the predetermined symbol will appear within the reel below his chosen position. The player thus has "intuitive" control of his payoff. Again, the choice is clearly intuitive. That is, regardless of which spin position and/or symbol is selected, the final spin result provided in the display area is the same. The reason for offering a choice of spin position and/or symbol is to enable the player to select the reel he feels that the predetermined symbol will appear under. It should also be understood that the reels may be, for example, either physical, computer-implemented, and/or video/electronic.

Intuitive Pays—First Random Bonus

The slot game according to one embodiment of the invention involves a first optional random bonus where the player is awarded, for example, for two or more contiguous, either diagonally or horizontally, equivalent pay symbols on one or more player-selected paylines. Other patterns may also be used alternatively, or in addition, to the contiguous reward or other rewards. Alternatively, the occurrence of scatter pay symbols count if they appear anywhere on the screen or restricted to specific columns, rows, and the like, and are optionally independent of the row or column they are in. In addition, scatter pay symbols advantageously and optionally pay a multiple of the Total Amount Bet.

Random Pays—Second Random Bonus

An exemplary embodiment of the present invention further includes bonus payouts that occur independent (i.e., randomly) of any player-selected payout line(s) and/or spin position. For example, when two or more predetermined symbols (e.g., treasure chests) appear anywhere within the display, the player may then be presented with a new display where he can select between, say, three sunken treasure chests, each of which have bonus credits associated therewith, or optionally only one or more bonus credits selectable by the player.

Similarly, if, for example, three of the predetermined symbols (e.g., golden oysters) appear anywhere on the screen, three divers may be presented on yet another display. Each of the three divers will, for example, dive for a predetermined number of pearls, where each pearl has bonus credits or selected pearls have bonus credits associated therewith. It is preferred that the player optionally be presented the opportunity to intuitively select one of the three divers and, if the player-selected diver accumulates the most credits, accumulate additional bonus credits. Thus, the additional bonus payout may initially be worth 1000 credits, and increase by, say, 100 credits each time the player does not select the winning diver. Thus, if the player correctly guesses the winning diver on, say, the sixth try, he will win 1500 credits, and the payout for the additional bonus credits will be reset to 1000 credits for the next bonus round.

Preferred Method

Figure 5A:
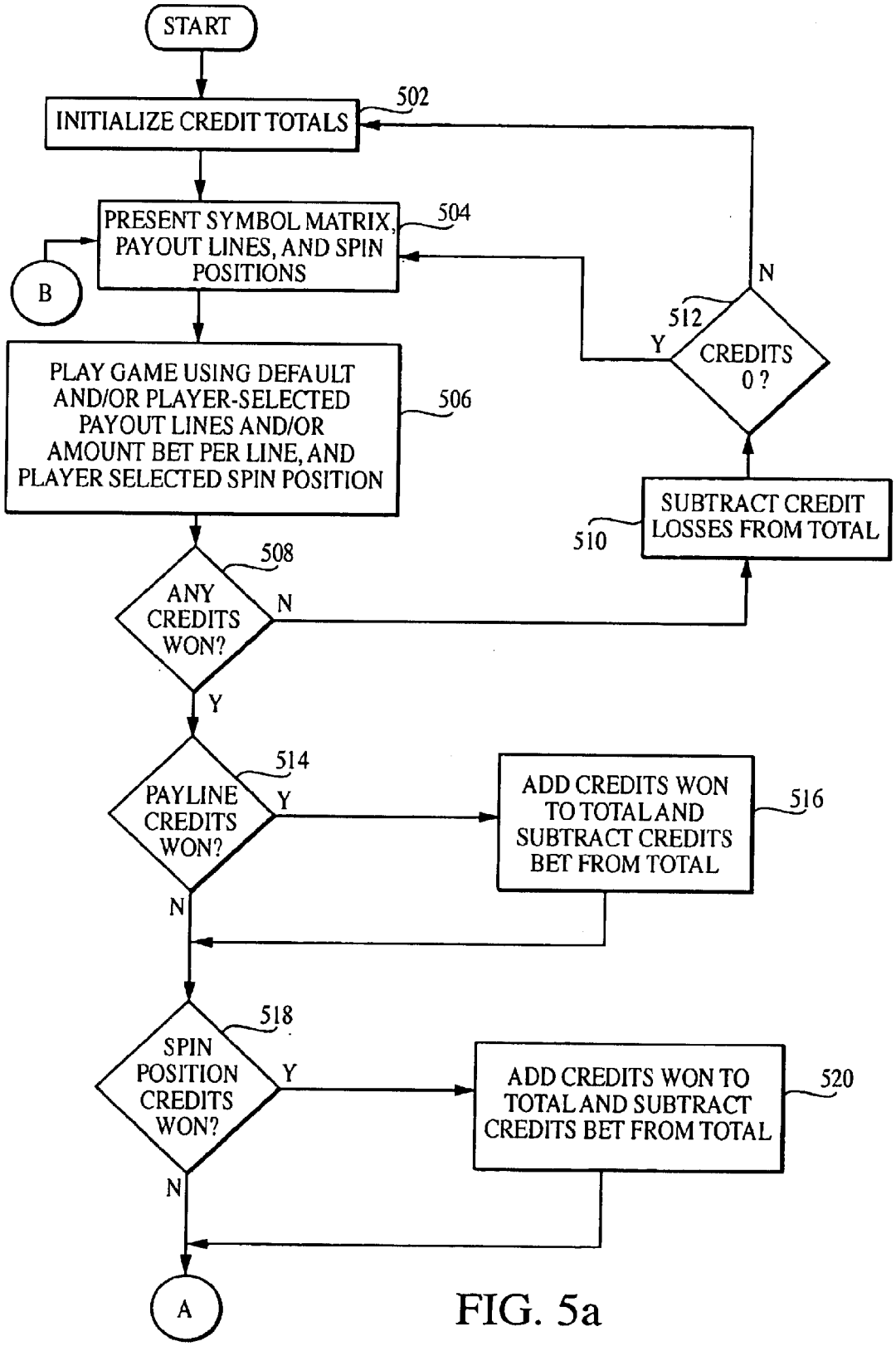
Figure 5B:
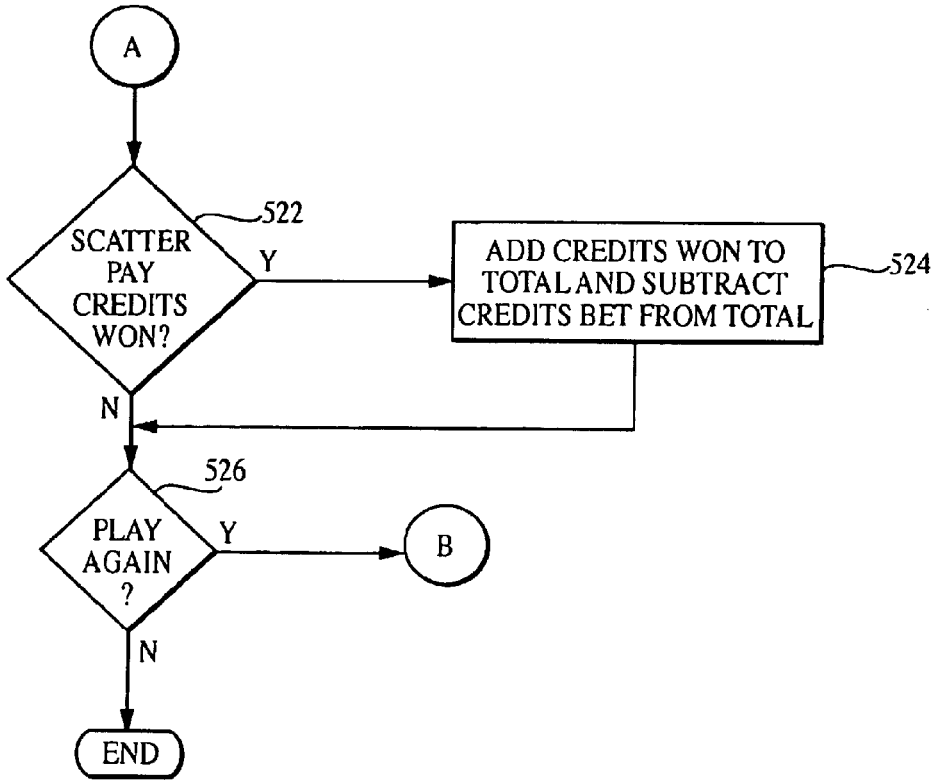

According to the principles of the present invention, a flowchart depicting one example of a process used to implement the game is illustrated in FIGS. 5*a*–5*b*. To begin, the game initializes player credits in accordance with a predetermined amount 502. Virtually any number of initial player credits can be offered. However, it should be kept in mind that in the exemplary embodiment, the player can, for example, wager up to 45 credits per play (e.g., 5 paylines at 9 points per payline). Thus, for example, if the player is awarded, say, 90 credits at the start of the game, the game would terminate after the second play unless the player won some additional credits in either the first and/or second play.

Then, the player is presented with a display that presents the player with a symbol matrix, a plurality of paylines that can be selected by the player, and a plurality of spin positions 504. One of the spin positions must be selected by the player play to start each round of the game.

In step 506, the player optionally selects one or more of a plurality of paylines and/or an amount bet per payline. Alternatively, the player can accept the default values for the number of paylines and/or the amount bet per payline. The player then optionally selects a spin position to start the game, after either having selected his own payline(s) and/or amount bet per payline or accepting the default values for each. The player can also optionally select a symbol or symbols.

If credits are won as determined in decision step 508, then a determination is made as to whether the credits won are payline credits (e.g., credits won as a result of there being two or more predetermined and/or pre-selected symbols along one or more player-selected paylines) 514. If yes, then the won credits are added to the player's total and the credits bet are subtracted from the player's total 516; if no, a test is made in decision step 518 if the credits won are spin position credits with optional pre-selected symbol or symbols. If yes, then the won credits are added to the player's total and the credits bet are subtracted from the player's total 520; if no, a determination is made as to whether the won credits are scatter pay credits 522 (e.g., credits won randomly, and thus won optionally independent of any player selected payline (s) and spin position). If yes, the won credits are added to the player's total and the credits bet are subtracted from the player's total 524; if no, the player decides if he wants to play again 526. If yes, the process returns to step 504; if no, the game ends.

It should be understood that any combination of the different types of payout can occur. Thus, for any given round of the game, a player may receive payline credits (as determined at 514), spin position and/or symbol credits (as determined at 518), and/or scatter pay credits (as determined at 520), and combinations of two or more of the above, including additional bonuses awarded therefore are possible.

Intuitive Play—Bonus Payout Lines

Figure 6A:
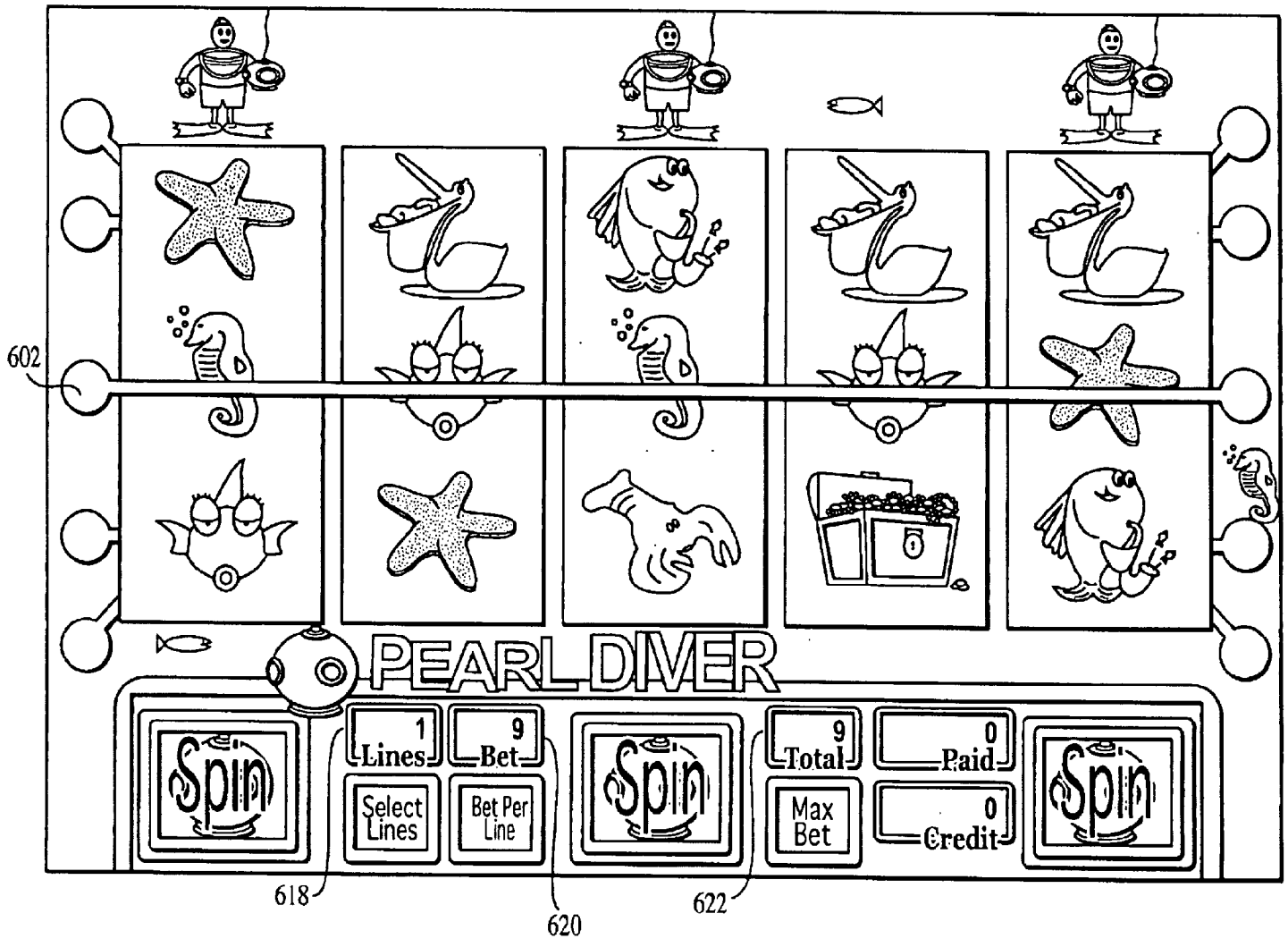
FIGS. 6*a*–6*g* illustrate different possible combination of player-selected paylines and points bet per paylines.

FIGS. 6*a*–6*e* show the exemplary paylines that the player can select. FIG. 6*a* shows a first payline 602. Note that payline indicator 618 shows that one line is selected, and bet indicator 620 shows that 9 credits are bet for the selected line 602. The total indicator 622 accordingly shows that 9 credits are bet for this round of the game.

Figure 6B:
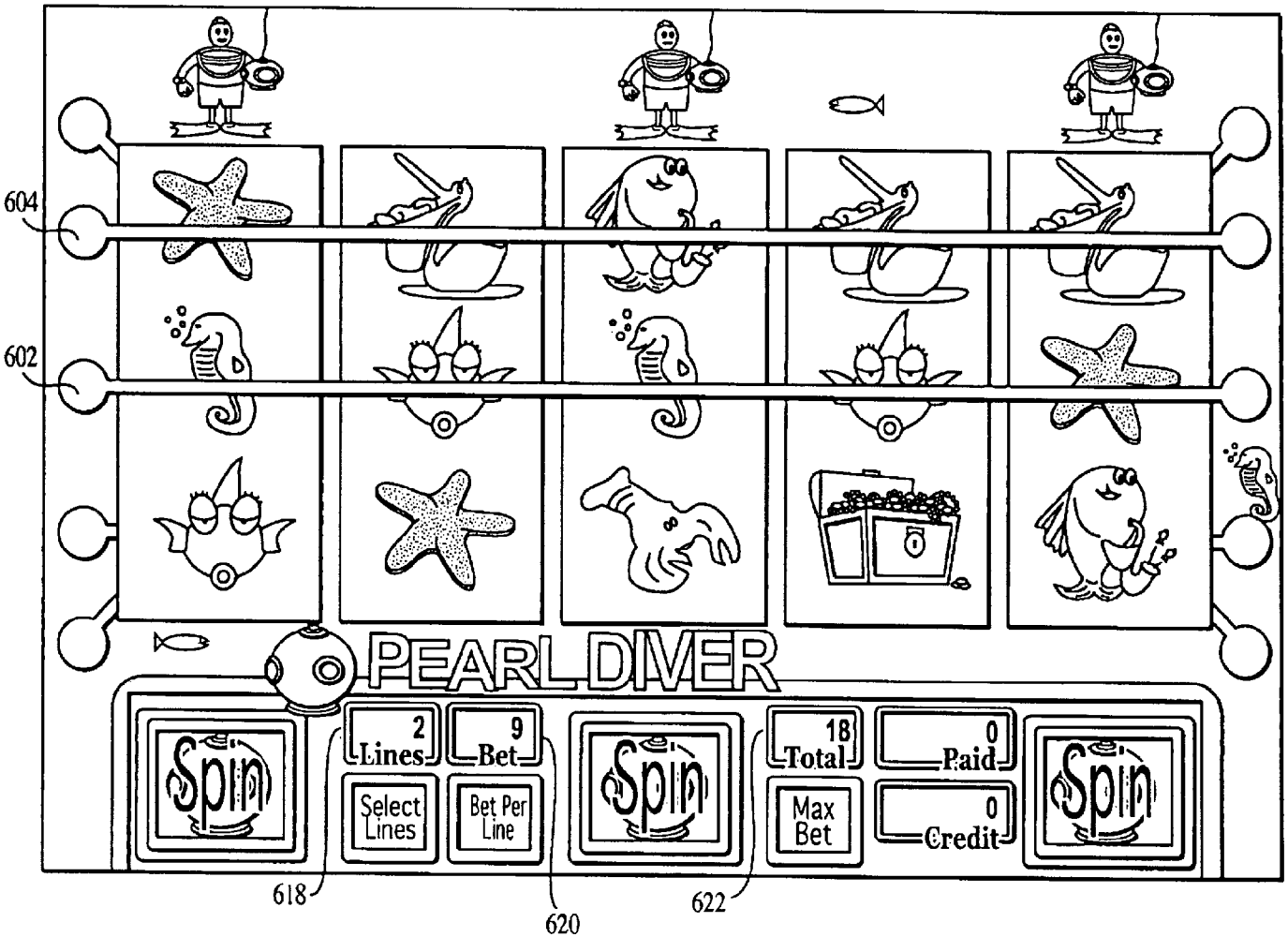
Figure 6C:
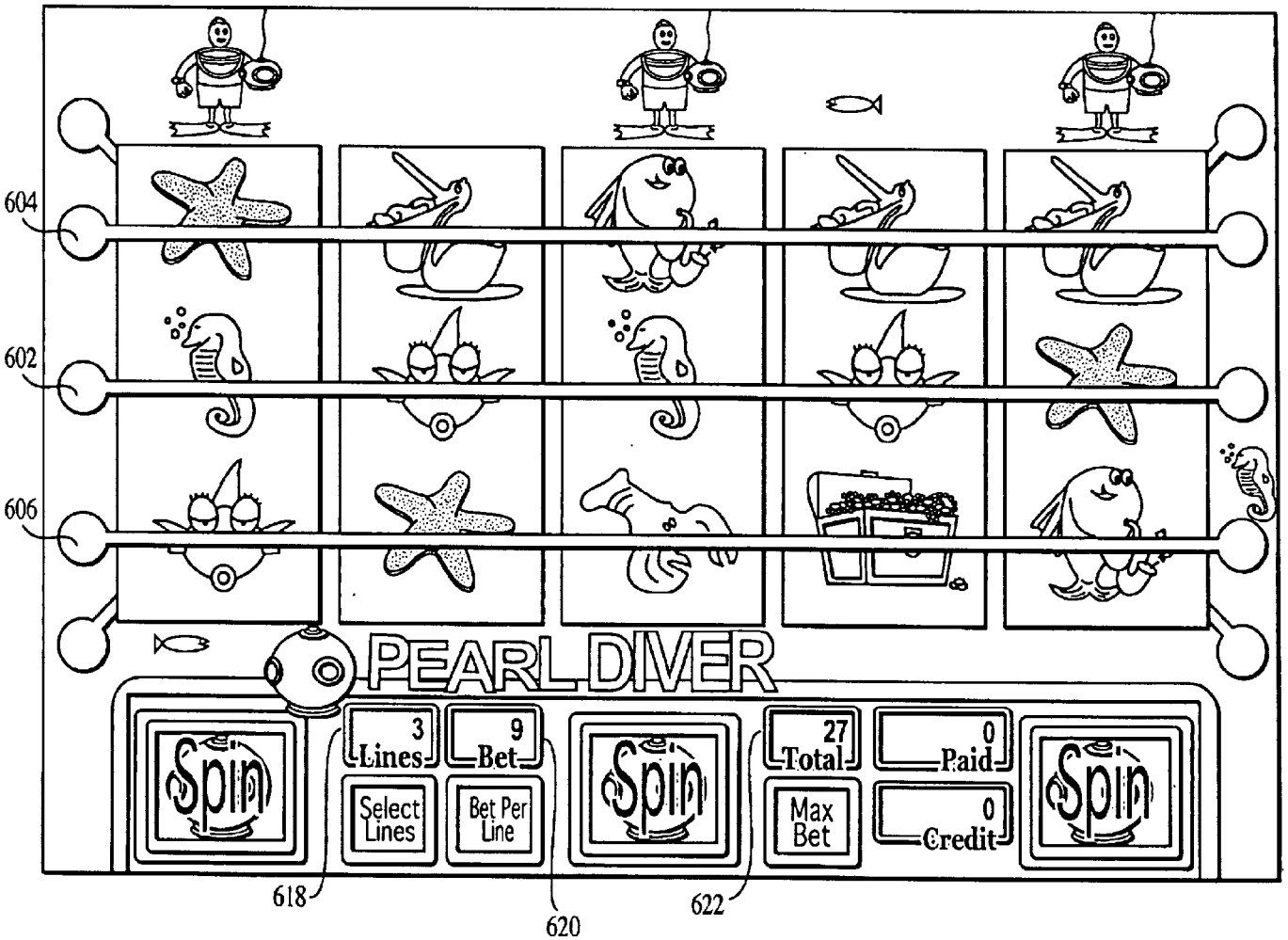
Figure 6D:
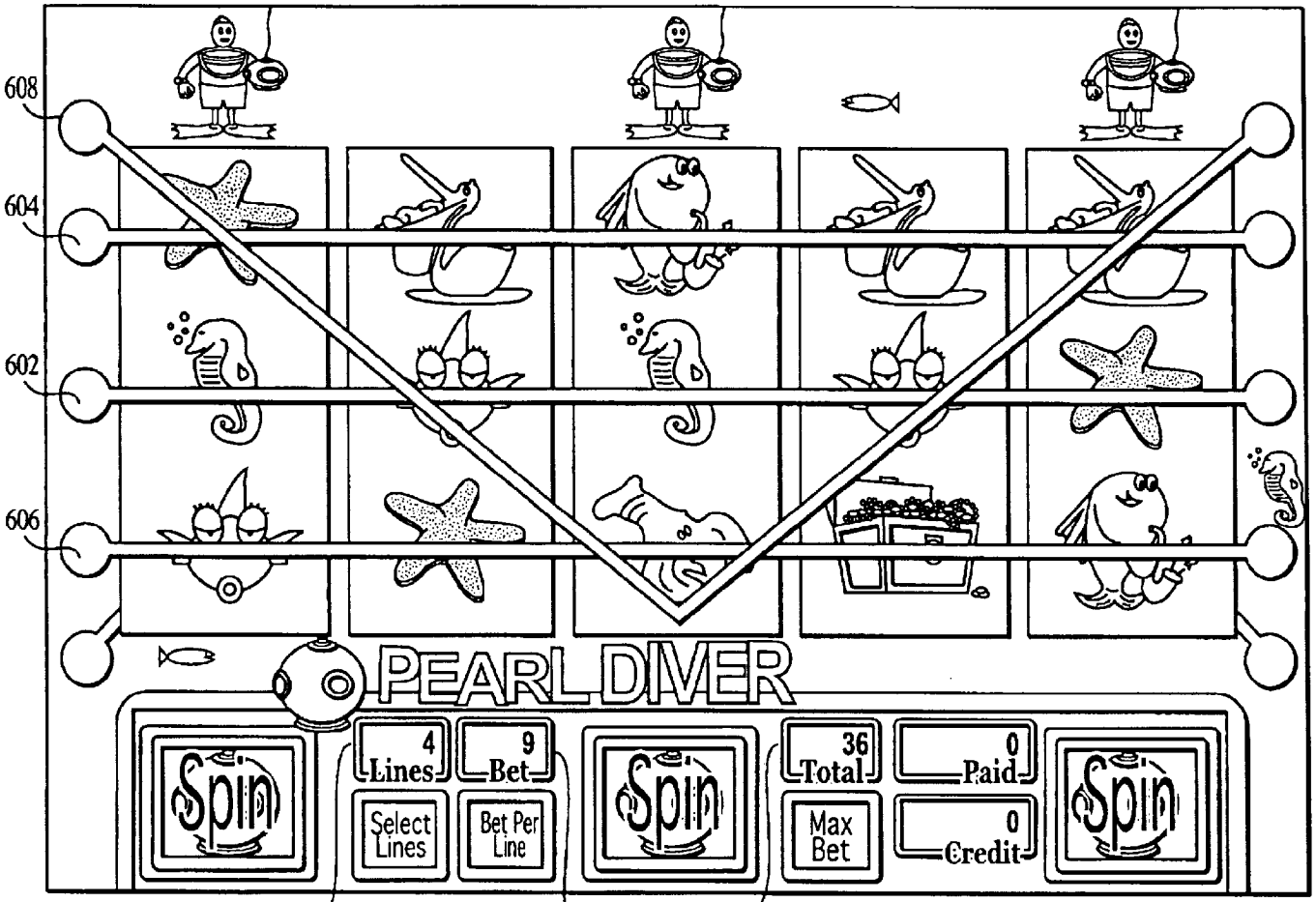
Figure 6E:
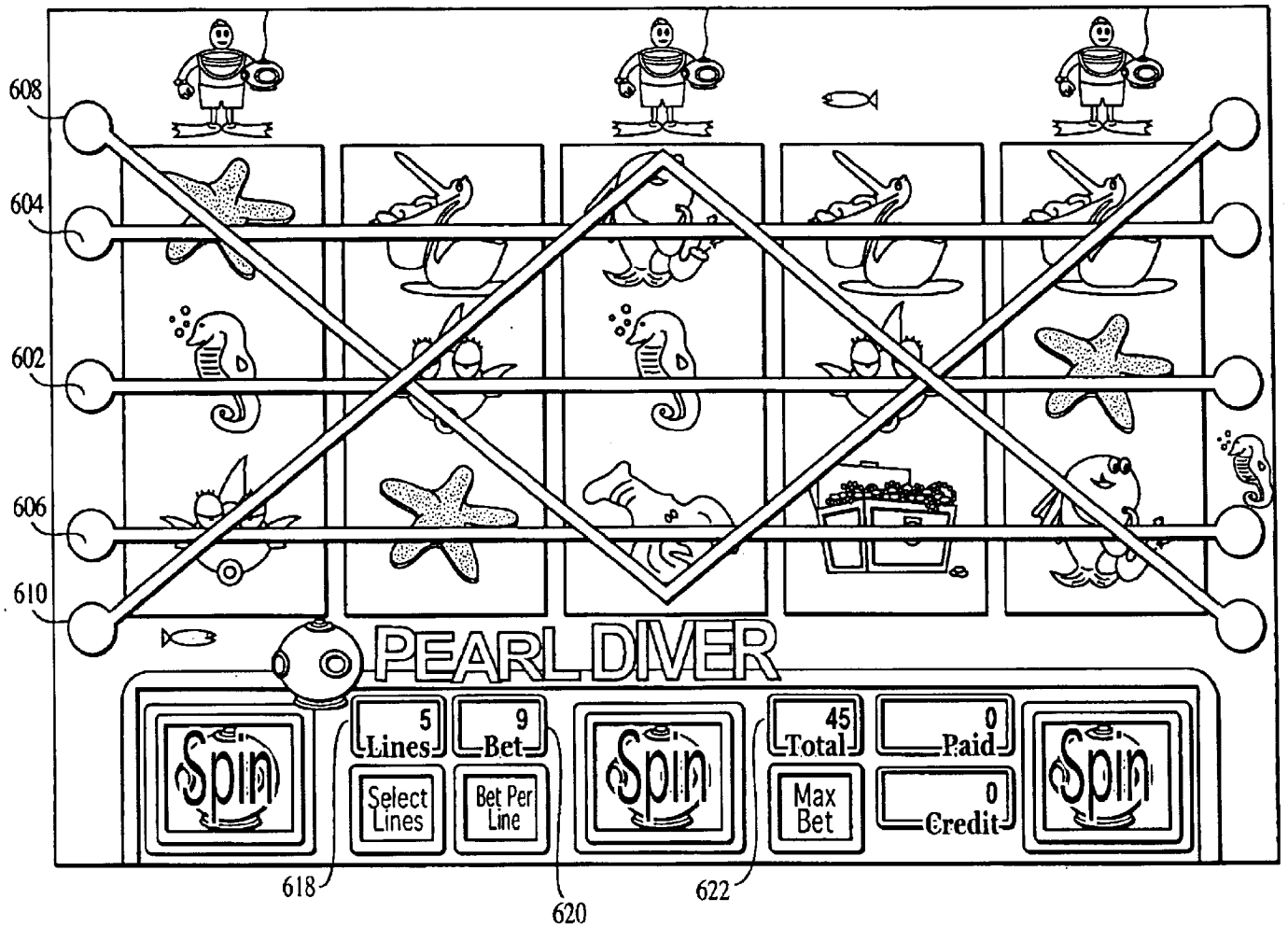

FIG. 6*b* shows first and second paylines 602 and 604, with the total indicator 622 showing 18 credits. FIG. 6*c* shows three paylines 602, 604, and 606, with the total indicator 622 showing 27 credits. FIG. 6*d* shows four paylines 602, 604, 606, and 608, with the total indictor 622 showing 36 credits. FIG. 6*e* shows five paylines 602, 604, 606, 608 and 610, with the total indictor 622 showing 45 credits. The present invention optionally includes other combinations of paylines and/or bets. The player may select, for example, paylines 602 and 608, and the amount bet for each of these payout lines. The player may also select, for example, paylines 606, 610, and 604. Other combinations of paylines may also be selected.

Figure 6F:
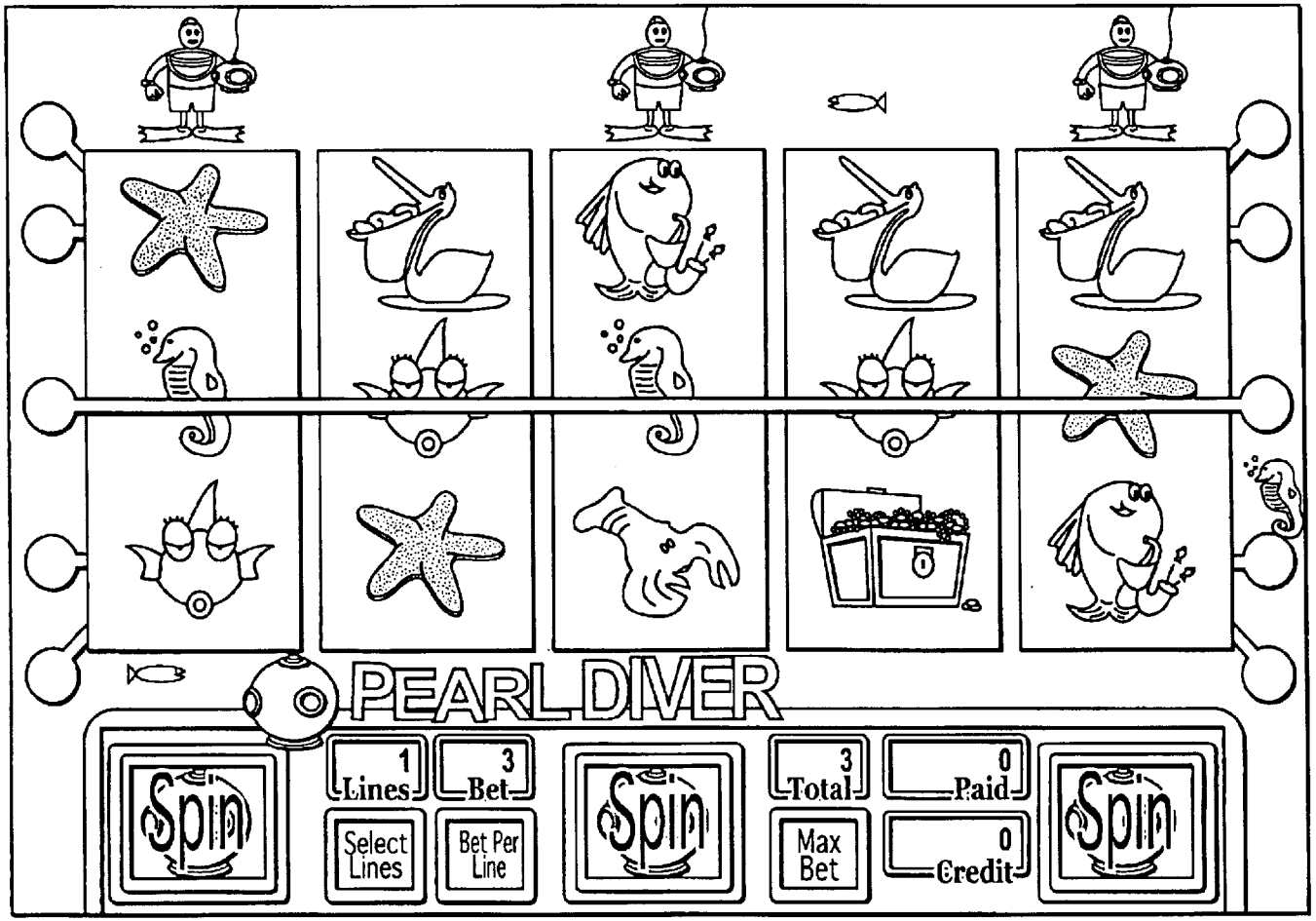
Figure 6G:
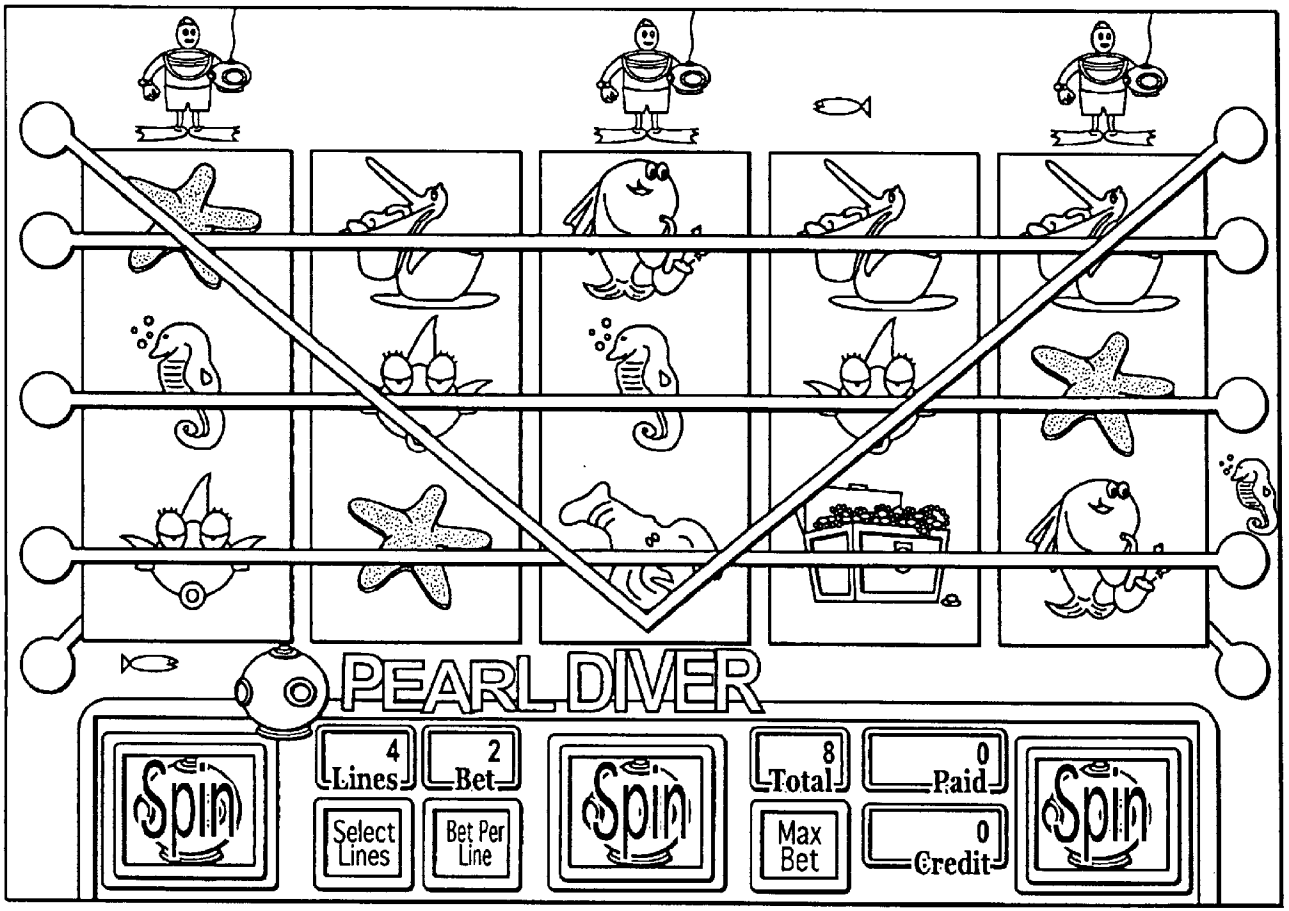

In general, as determined by a particular embodiment, there can be 1 to m paylines, with 1 to n credits per line, with a total of m×n credits per round. To illustrate this concept, FIG. 6*f* illustratively shows 1 line bet at 3 credits per line, and FIG. 6*g* shows 4 lines bet at 2 credits per line for a total of 8.

Intuitive Play—Spin Position

Figure 7A:
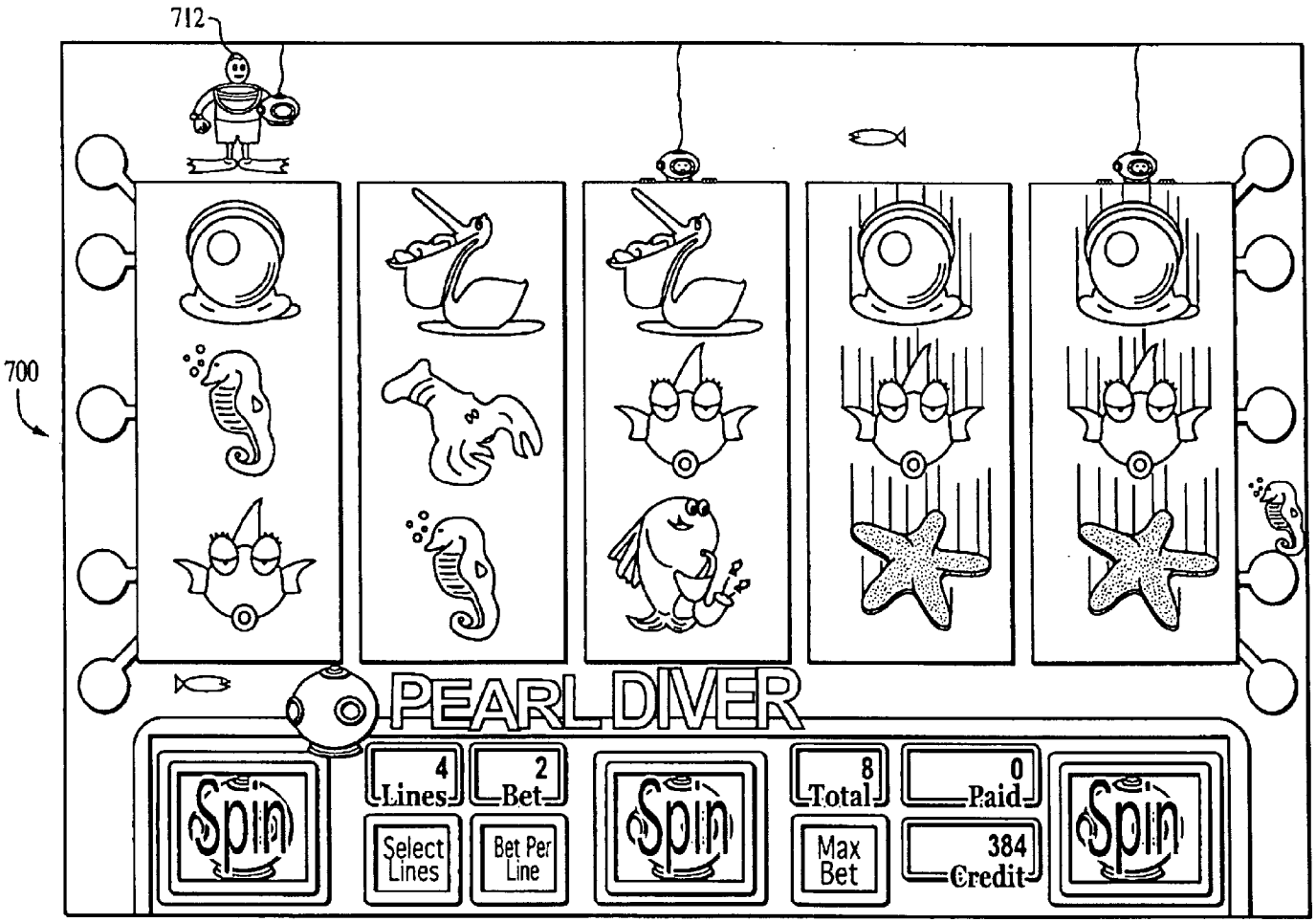
FIGS. 7*a*–7*c* illustrate different player-selected spin positions within the display.
Figure 7B:
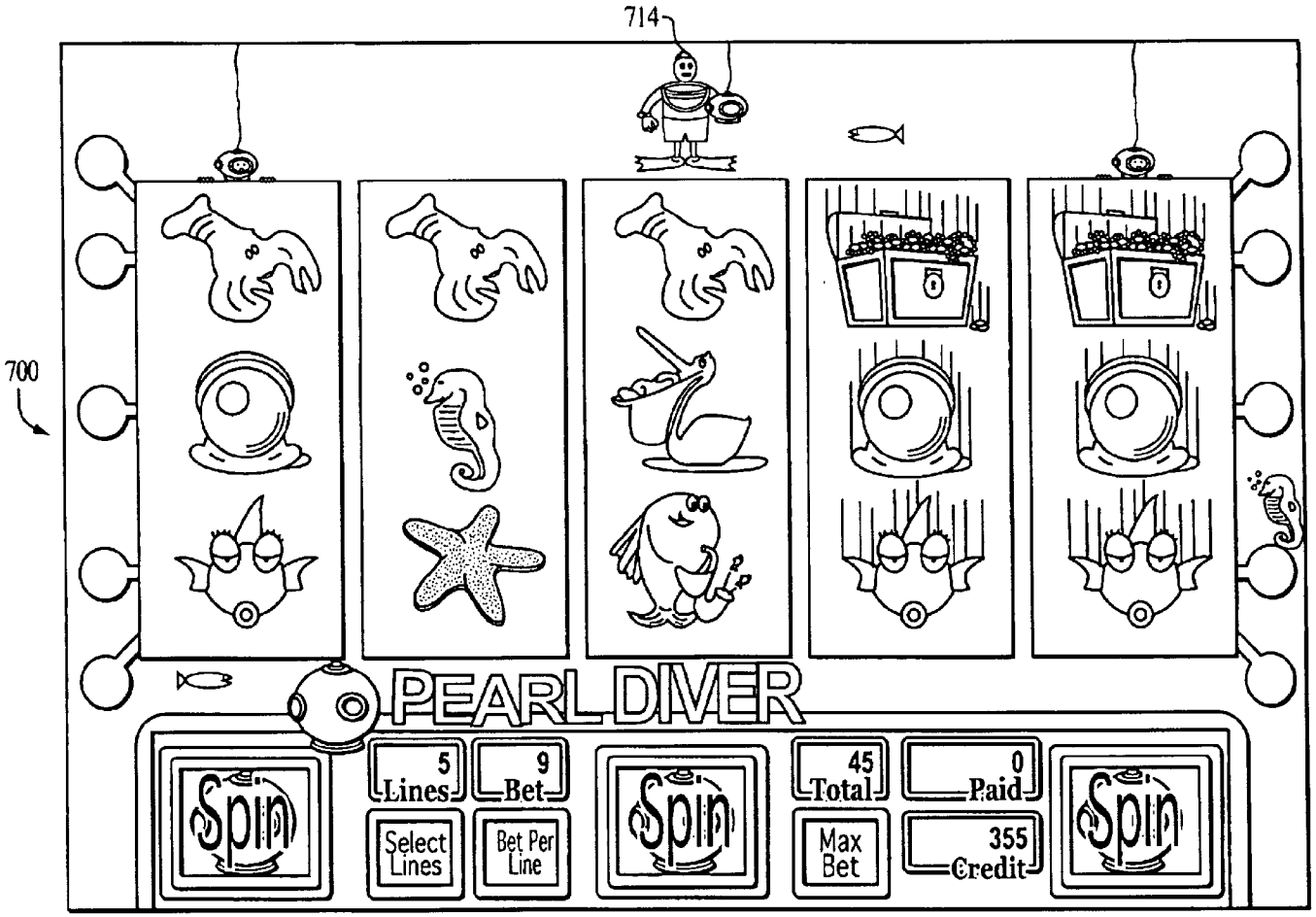
Figure 7C:
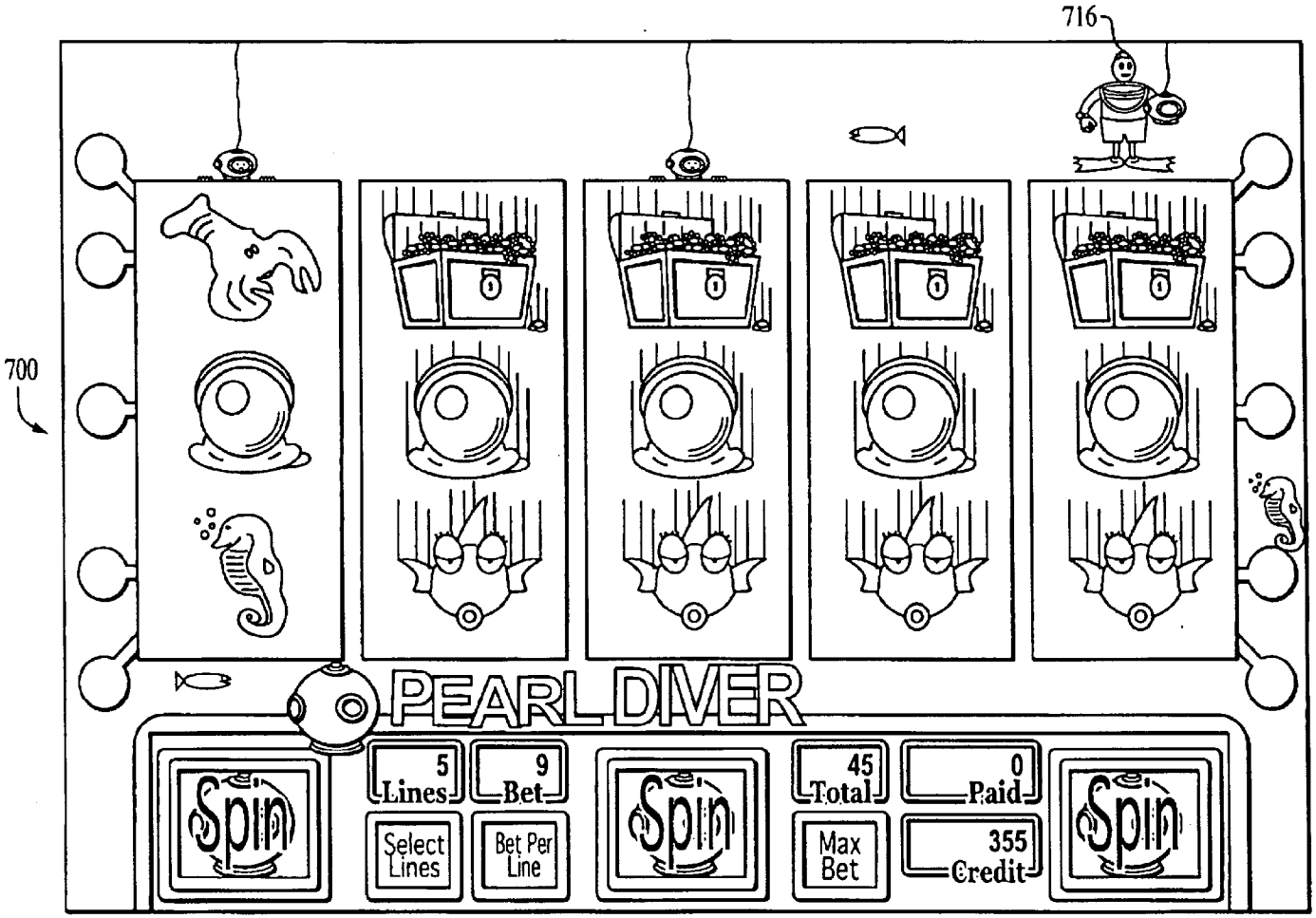

FIG. 7*a* shows a representative display 700 when the first spin position 712 is selected. FIG. 7*b* shows the representative display 700 when the second spin position 714 is selected. FIG. 7*c* shows the representative display 700 when the third spin position 716 is selected. The selection of each respective spin position is indicated by the respective diver being present within the display 700, with the other two divers being optionally at least partially hidden. FIG. 7*a* thus shows the diver just above column 1 of the display 700 in full view, with the diver just above column 3 of display 700 and the diver just above column 5 optionally partially hidden. Similarly, FIG. 7*b* shows the diver just above column 3 of the display 700 in full view, with the diver just above column 1 of the display and the diver just above column 5 of the display 700 optionally partially hidden. FIG. 7*c* shows the diver just above column 5 of the display 700 in full view, with the diver just above column 1 of the display 700 and the diver just above column 3 of the display 700 optionally partially hidden.

The final spin results of pressing any of the spin buttons 712, 714, 716, shown in FIGS. 7*a*, 7*b* and 7*c*, respectively, are identical, and the only reason for offering a choice is that a subset of the final symbol set within the display is associated with one of the three buttons 712, 714, 716. That is, selection of one of the buttons (e.g., 712) selects a reel associated with the button. Note that FIGS. 7*a*–7*c* show each respective display in a spinning condition (e.g., see columns 4–5 of FIGS. 7*a* and 7*b*, and columns 2–4 of FIG. 7*c*). In an electronic and/or computer-implemented version of the present invention, it is not necessary that the reels (e.g., columns) actually spin. That is, the final symbols may appear within the display at the end of each played round without providing any spinning effect.

In a preferred embodiment of the invention, the numeric keys "1", "3", and "5", corresponding to the reel (i.e., column number) of each respective diver, will be pressed in order to select the respective diver to activate each round of the game. Other keys or processes or devices can optionally be used to activate the spin wheels or, alternatively, similar mechanisms or alternatives can also be used (e.g., a touch screen, mouse, etc.). Further, for this concept to work it is not necessary for there to be three separate spin buttons 712, 714, 716. An alternative representation could have, for example, the three reels associated with respective spin buttons 712, 714, 716 light up one at a time, in sequence and for the player to simply choose his preferred reel by pressing the spin button at the appropriate time. Rather, the important feature in accordance with the present invention that the player is provided with is the ability to select a specific display domain, such as a display area(s), symbol(s), line(s) and/or spin position. Further, as previously noted, any number of reels may also be used with any number of symbols in a column and/or row.

With reference again to FIGS. 6*a*–6*g* and 7*a*–7*c*, it should now be apparent that the intuitive plays feature allows a player to select one or more display areas, such as a corresponding spin position and/or symbol 712, 714, or 716, and/or paylines 602, 604, 606, 608, and/or 610, before activating each round of the game. In the preferred embodiment, the spinning of the reels of the slot machine 700 are activated by the player selecting a display domain, such as a display area or a spin position 712, 714, or 716, preferably by means of, say, an input device pressing an associated key on a standard keyboard or via a standard mouse. Alternatively, a slot handle or other device can equally be used in a physical implementation. It should also be understood that to practice the invention the reels do not have to spin, either physically or electronically. That is, symbols may appear within the display after the player selects a spin position, without any spin effect being shown in the display.

Illustrative Displays

Figure 8A:
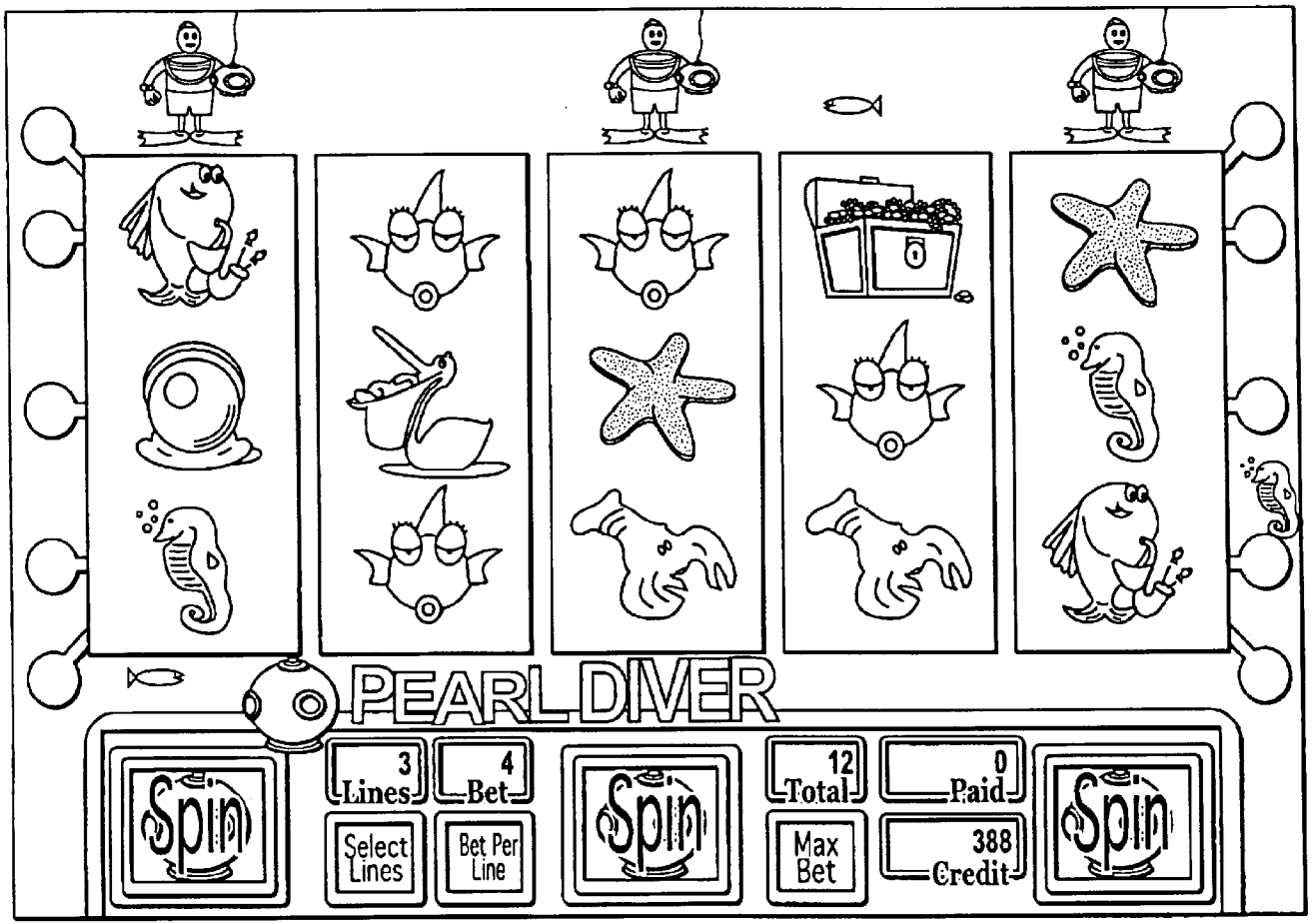
FIGS. 8*a*–8*p* show an illustrative example of representative displays that may be encountered during a typical game in accordance with the principles of the present invention.
Figure 8B:
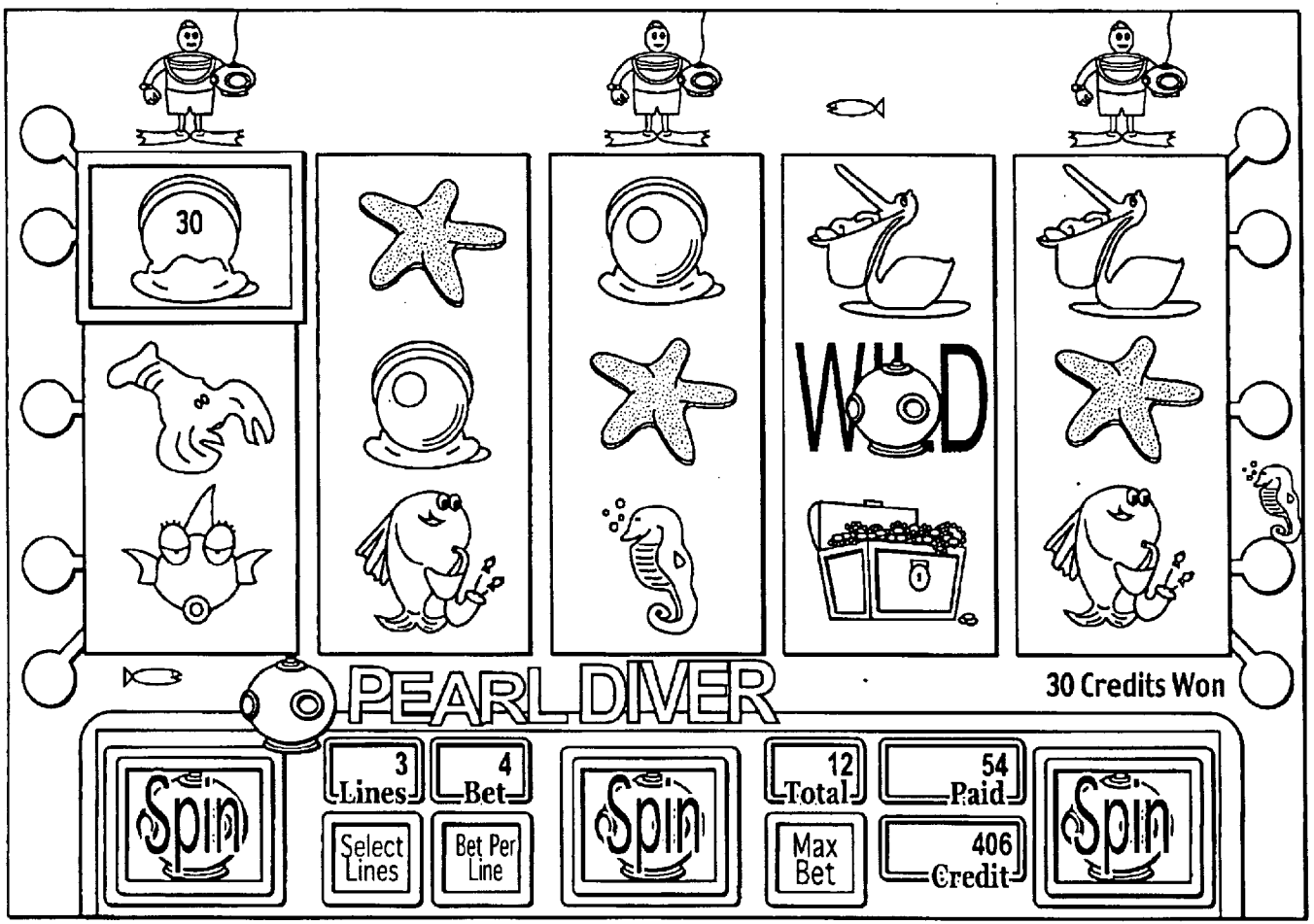
Figure 8C:
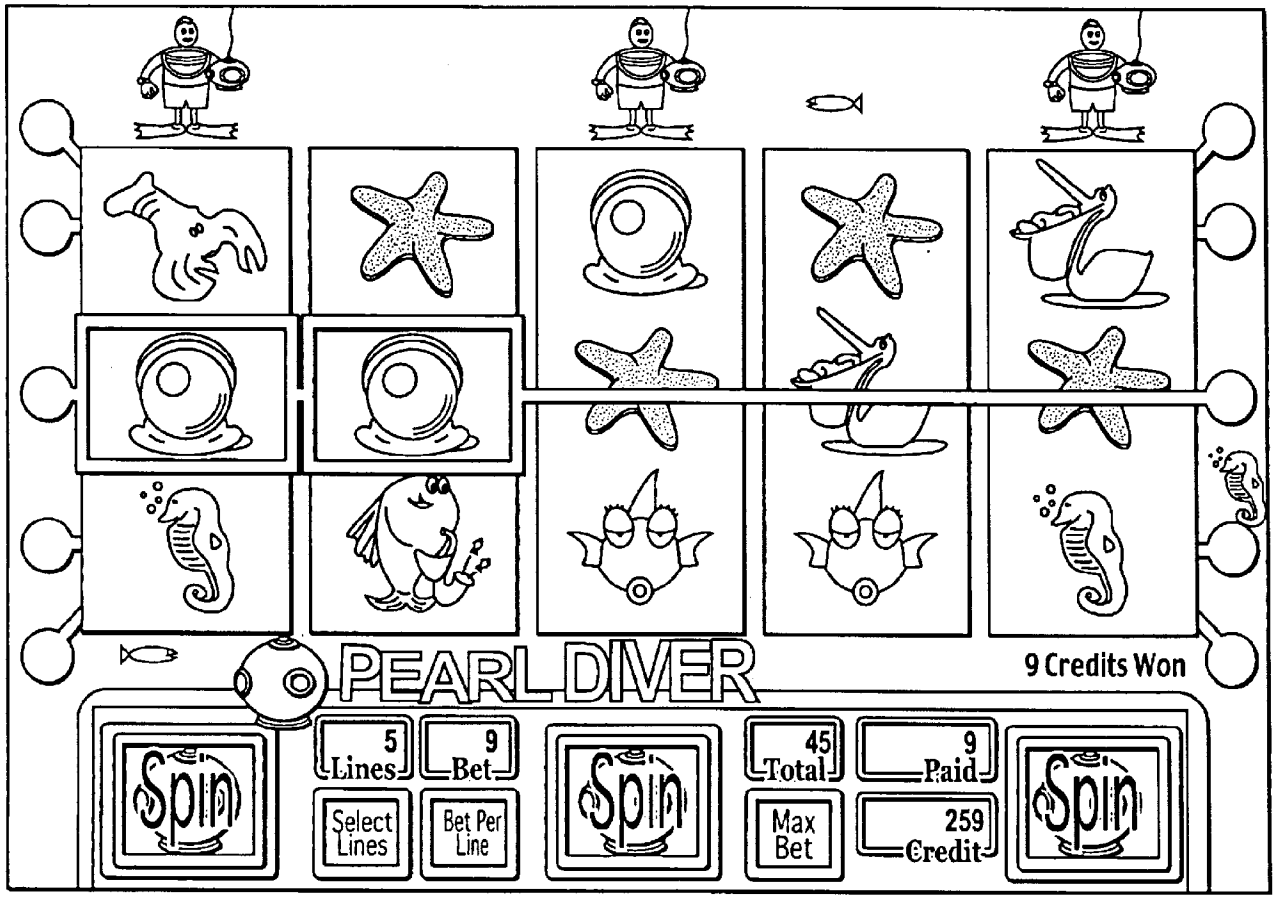
Figure 8D:
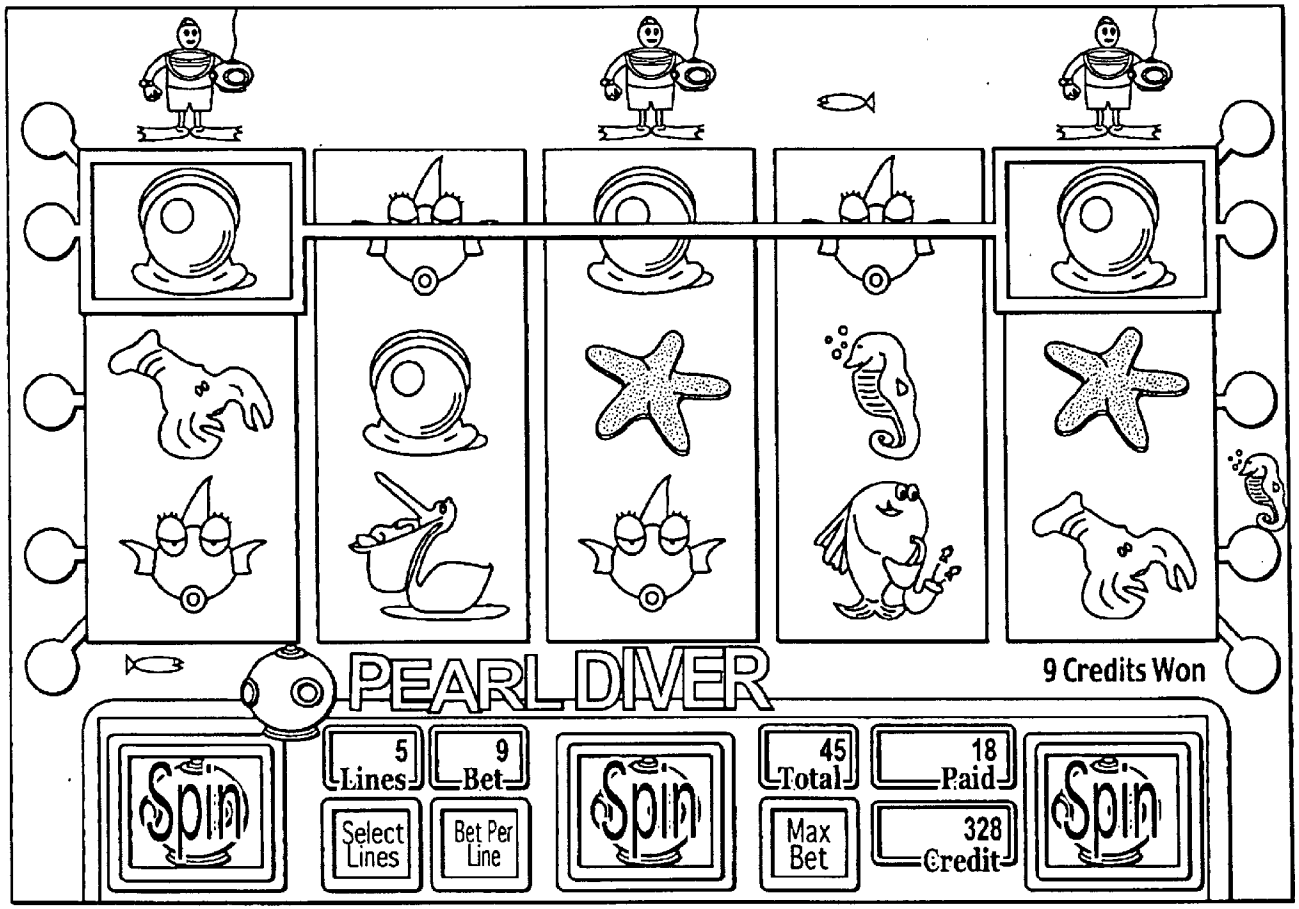
Figure 8E:
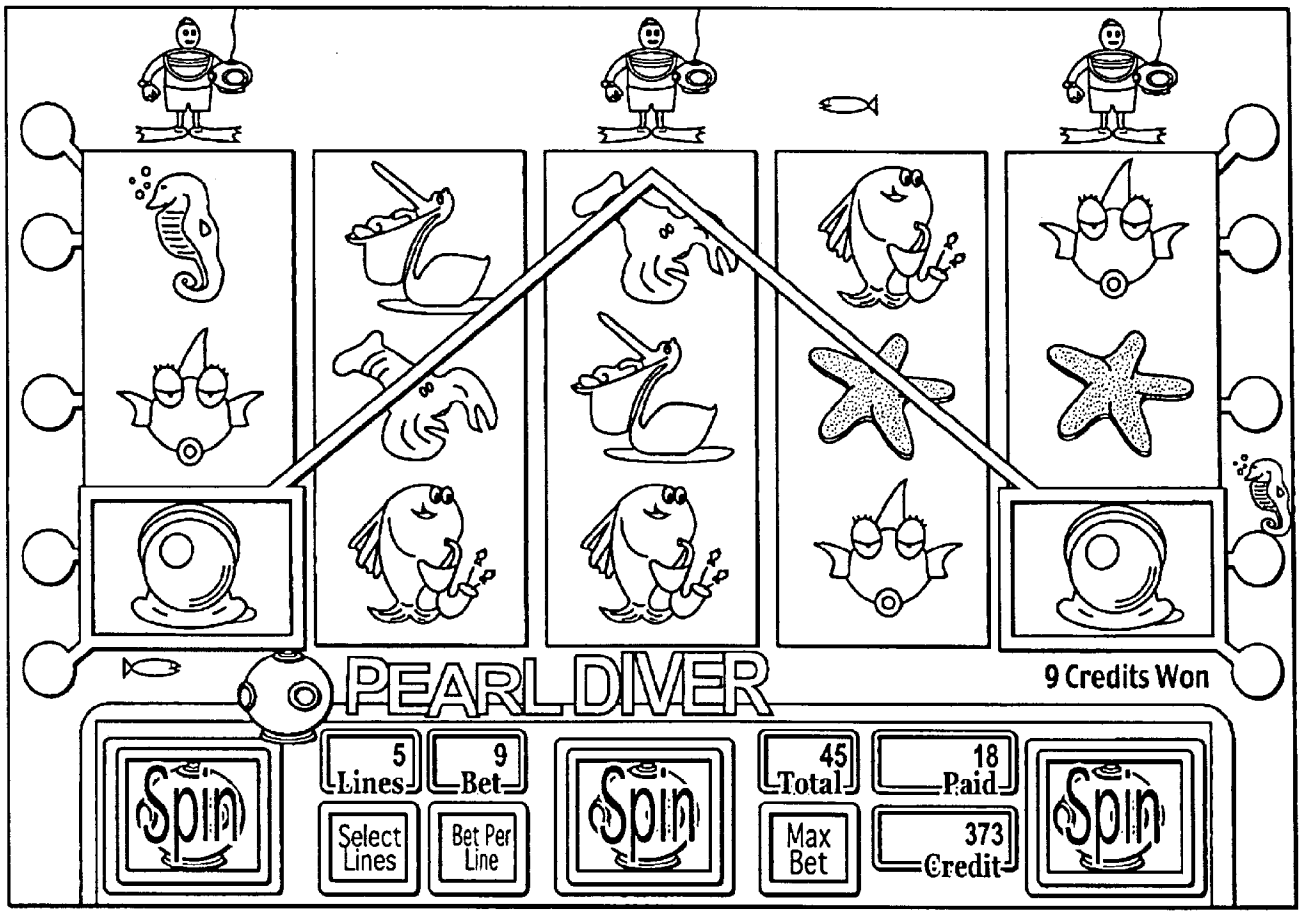
Figure 8F:
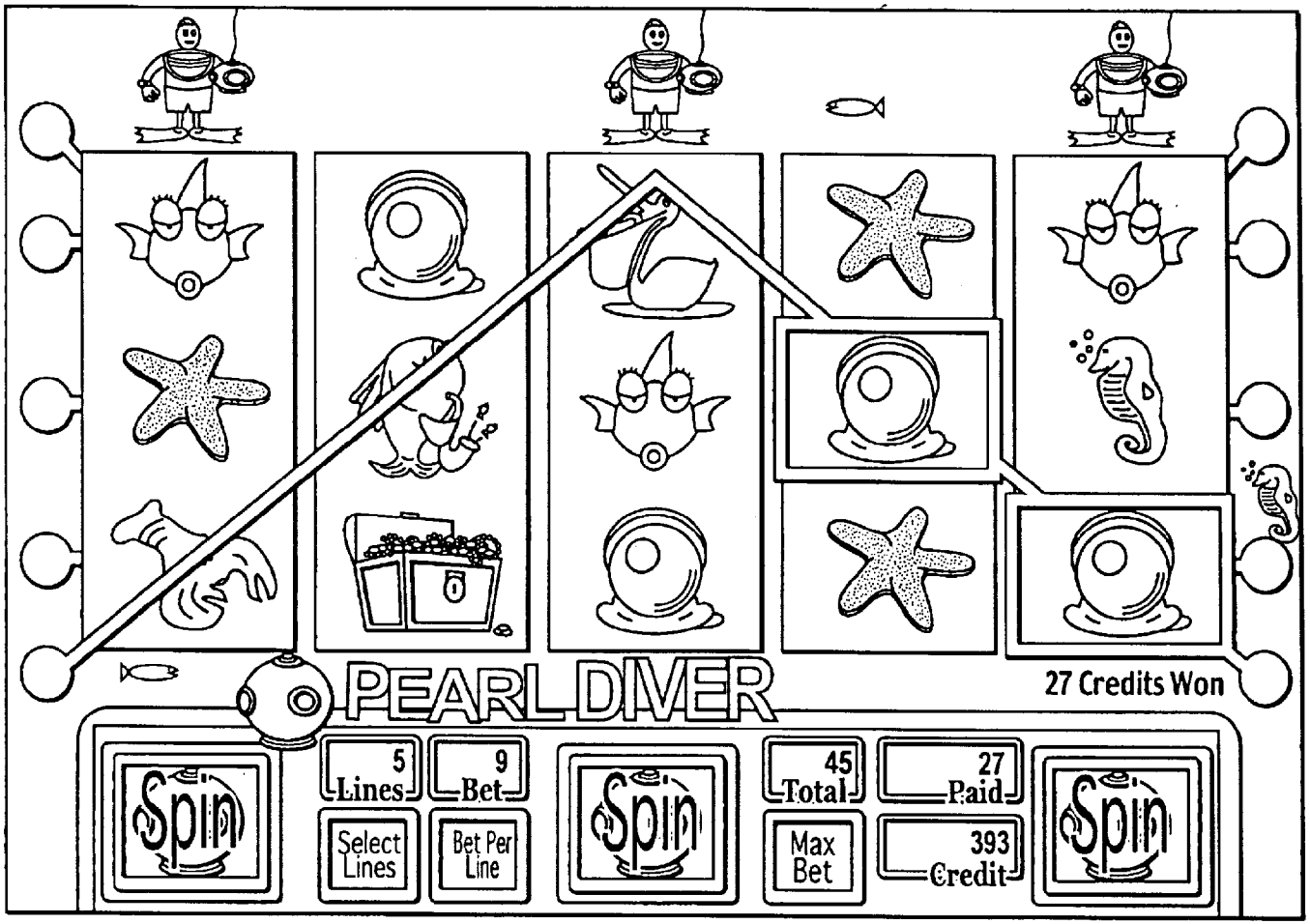
Figure 8G:
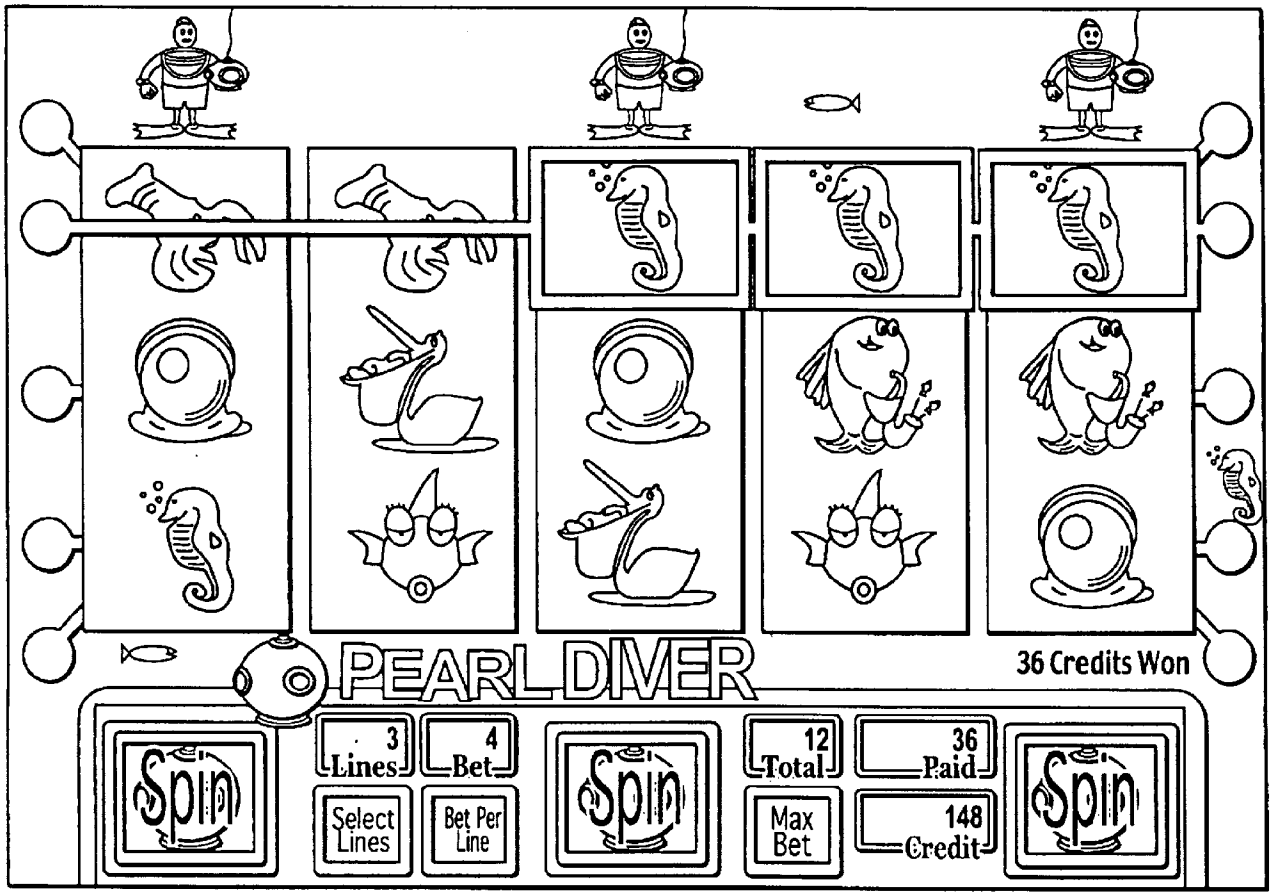
Figure 8H:
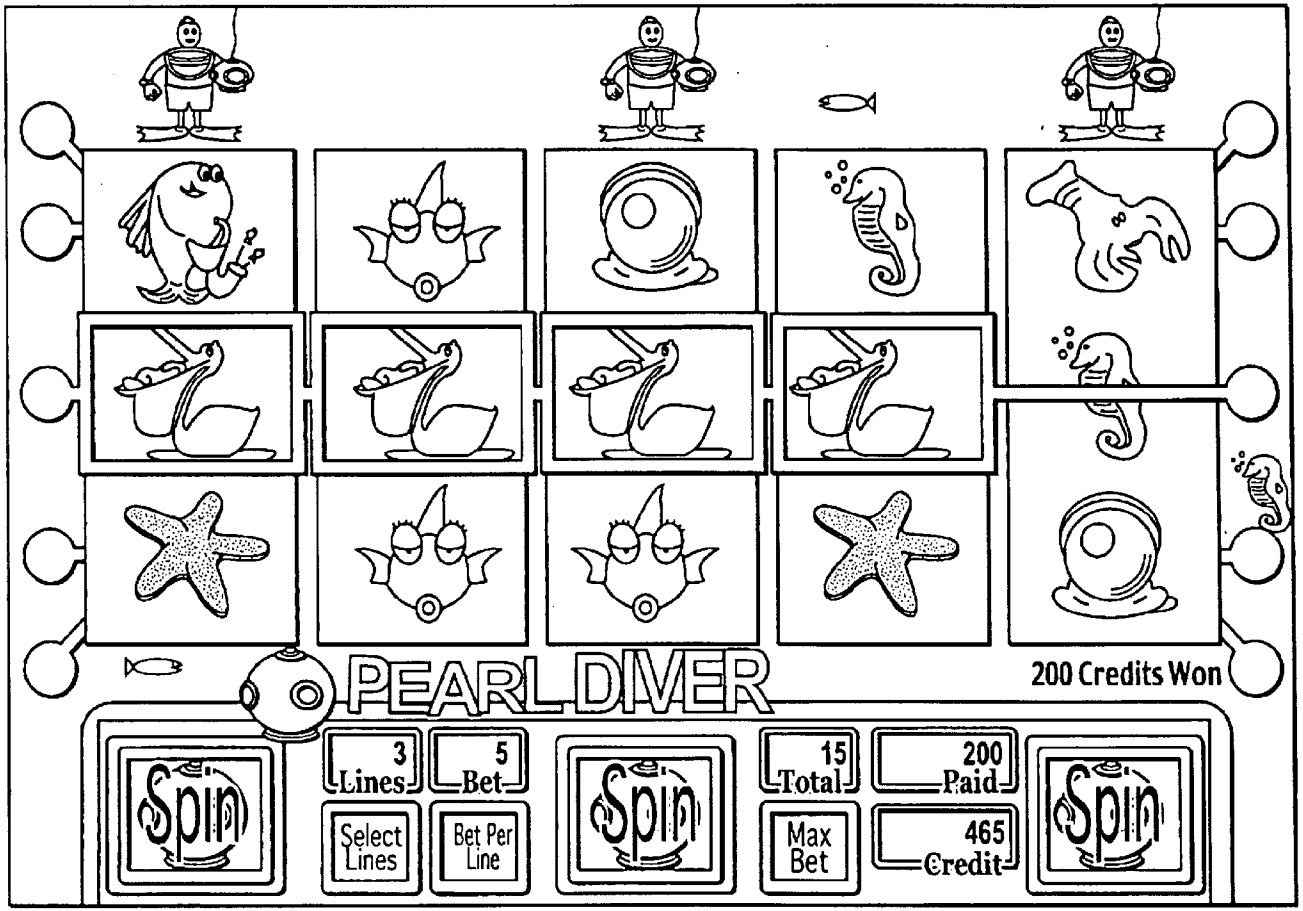
Figure 8I:
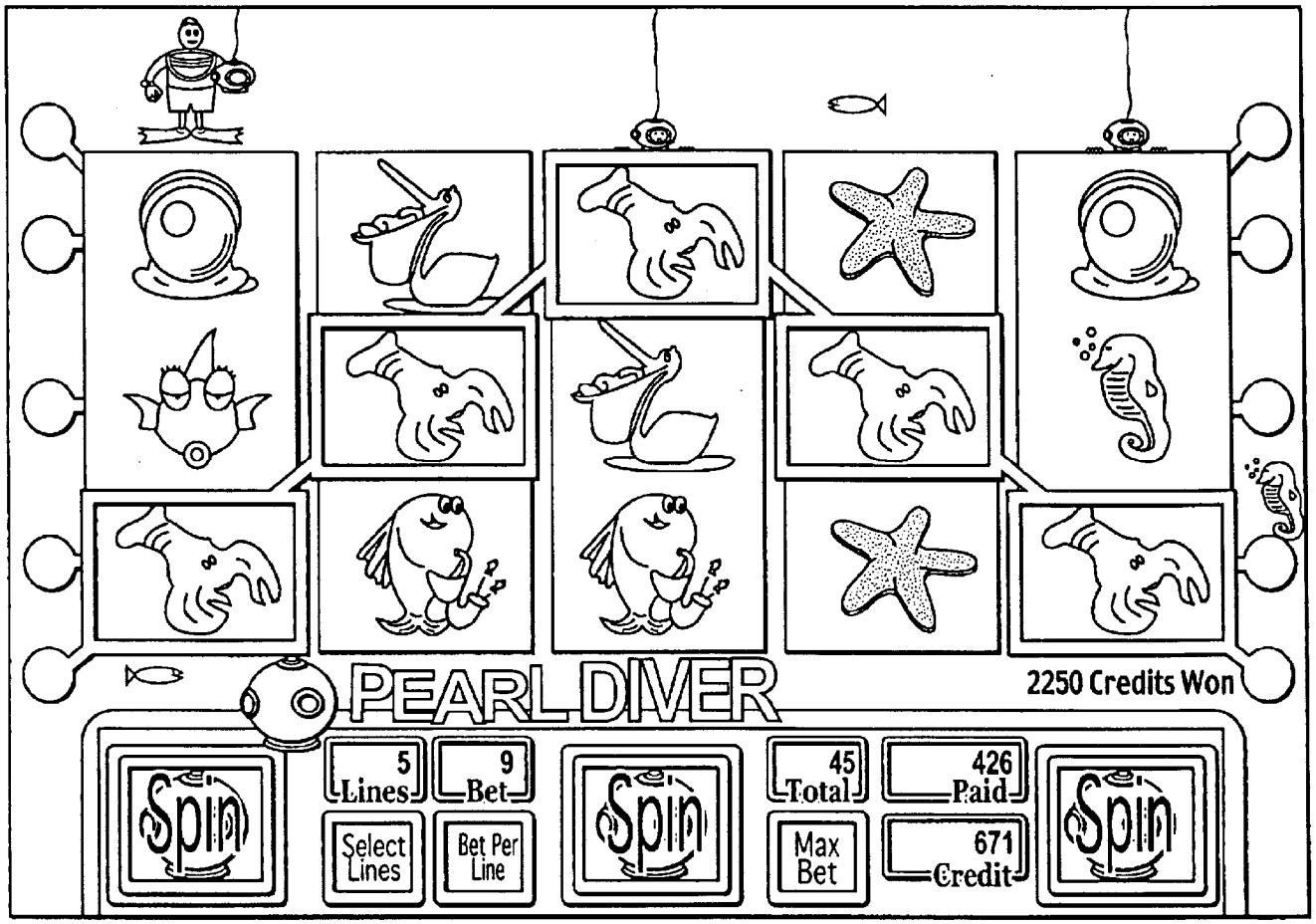
Figure 8J:
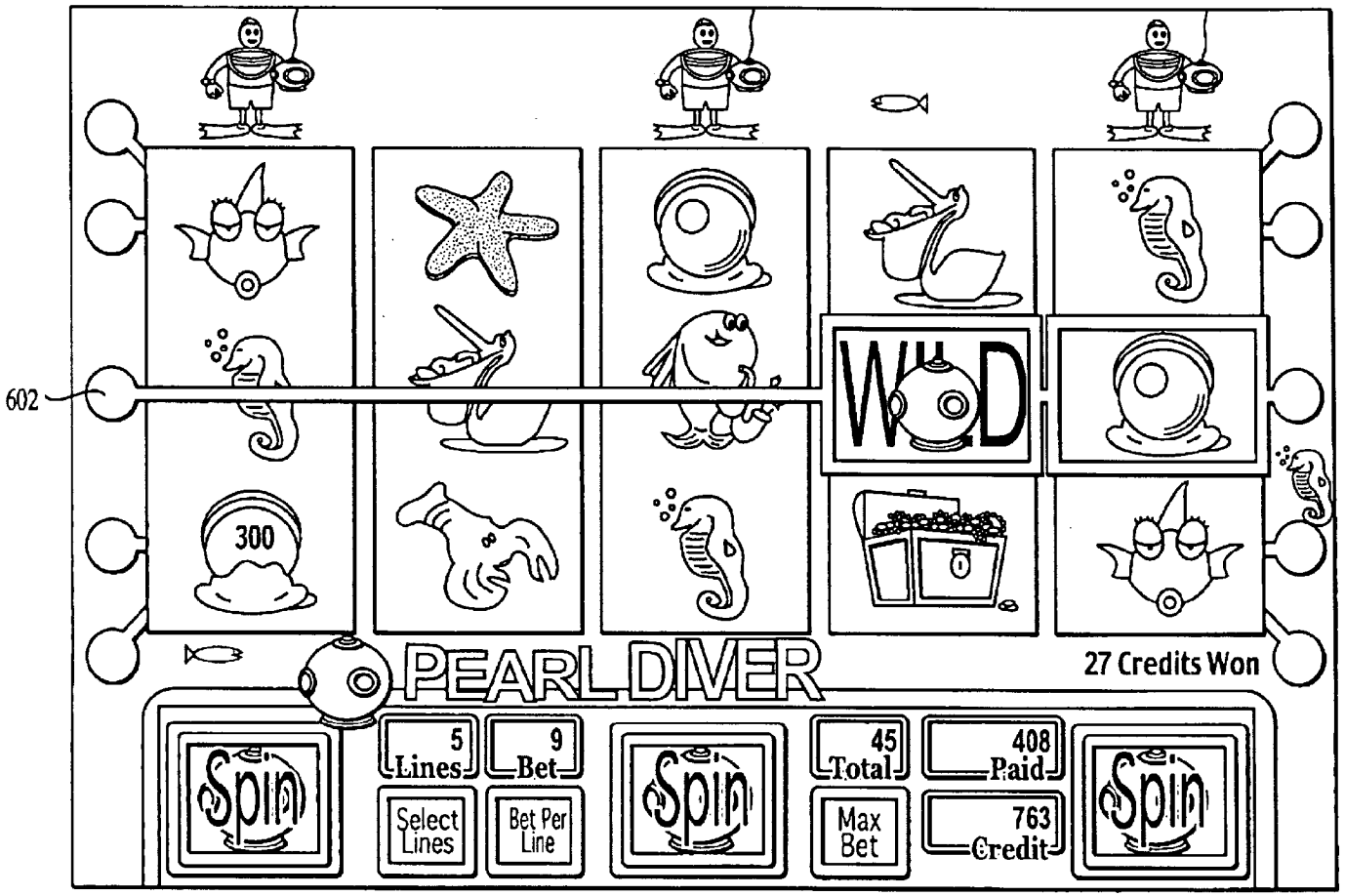
Figure 8K:
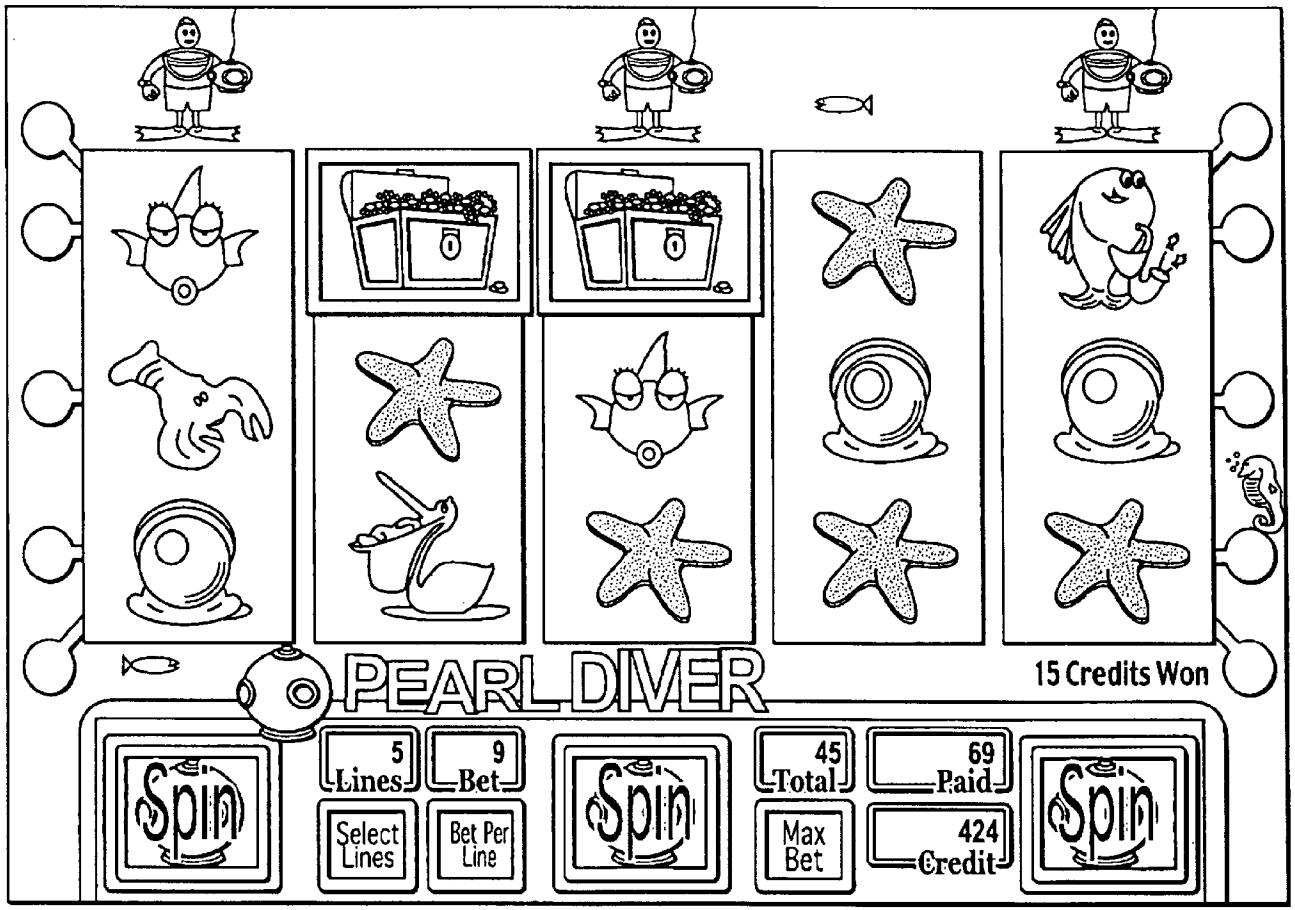
Figure 81:
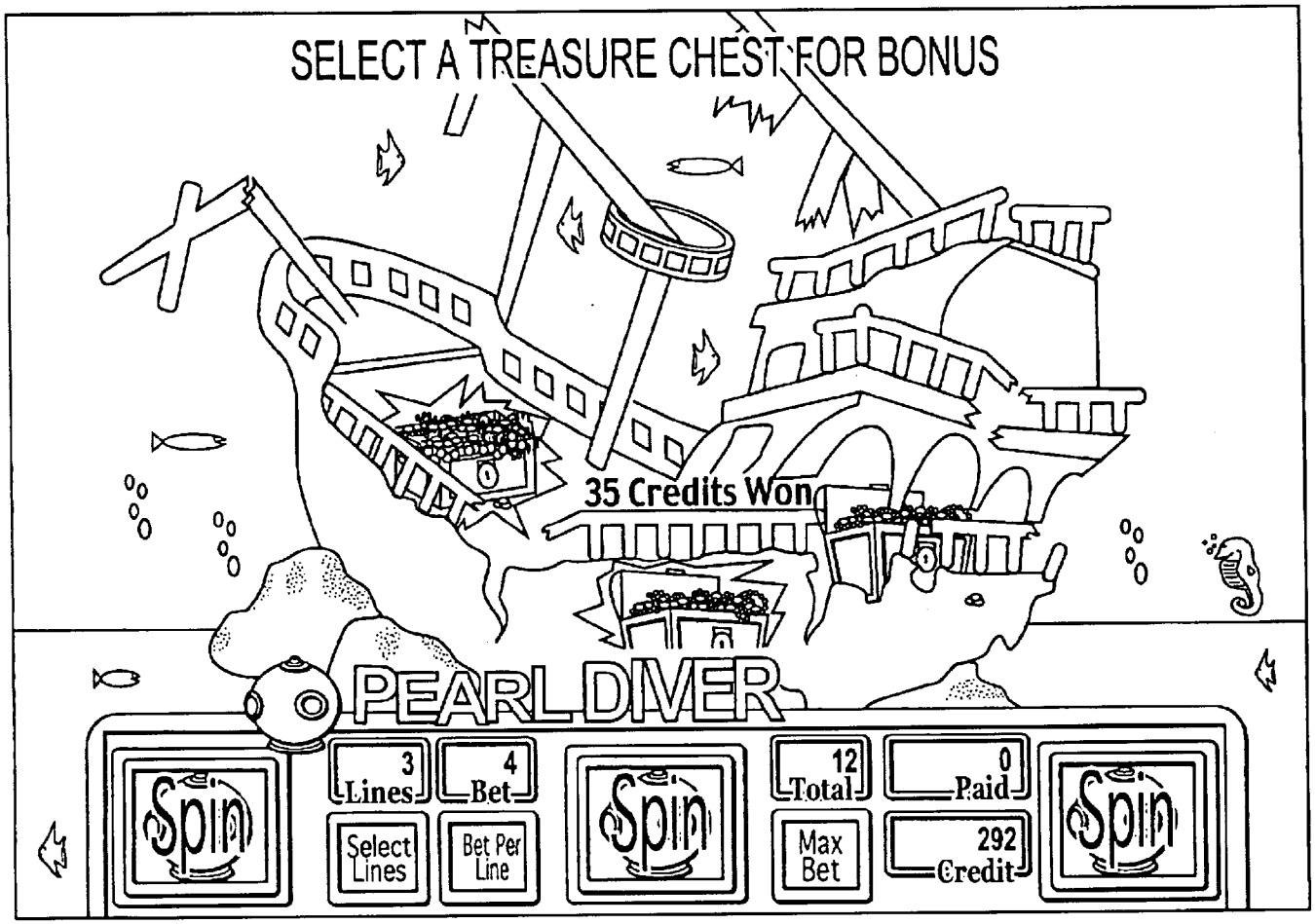
Figure 8M:
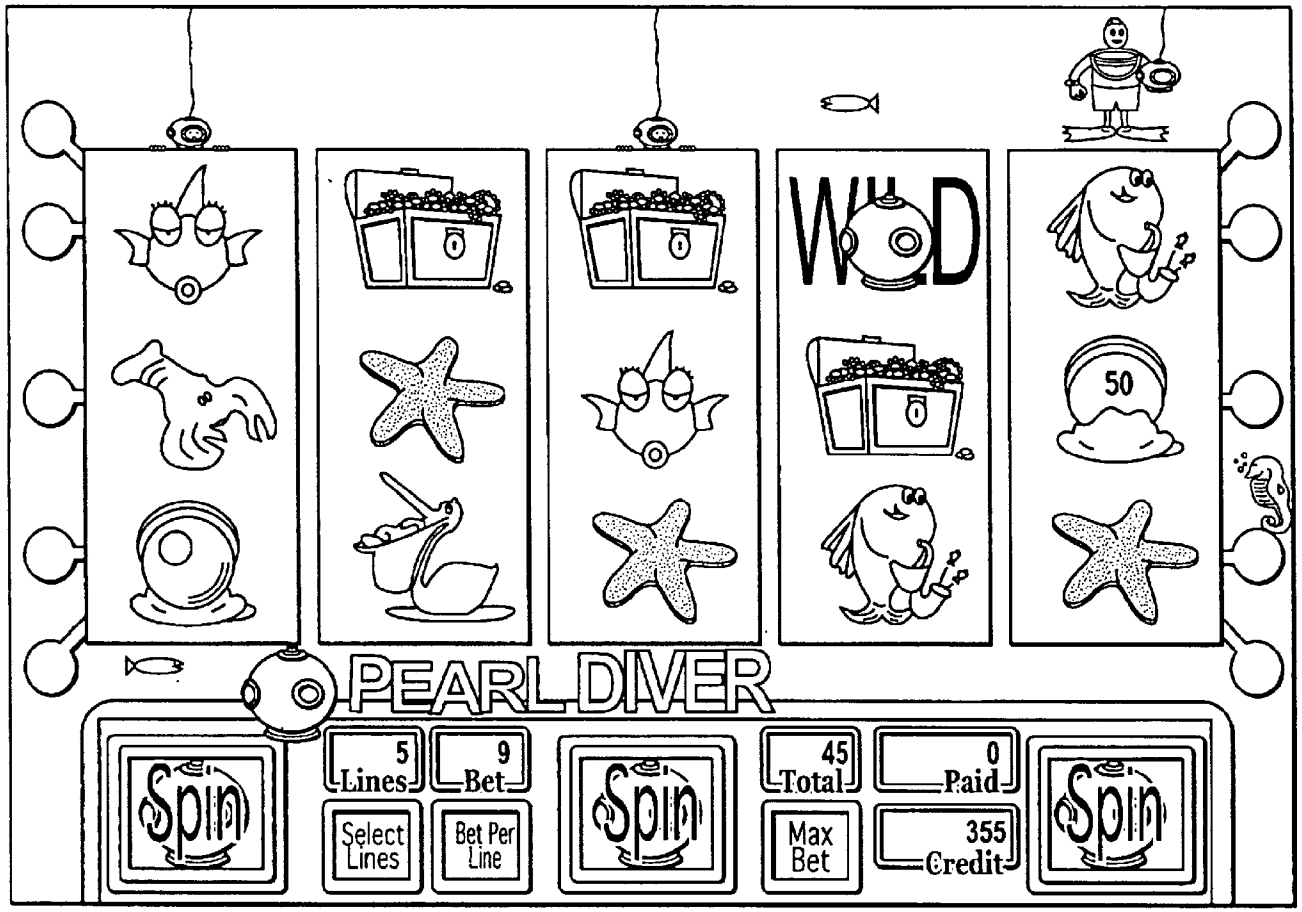
Figure 8N:
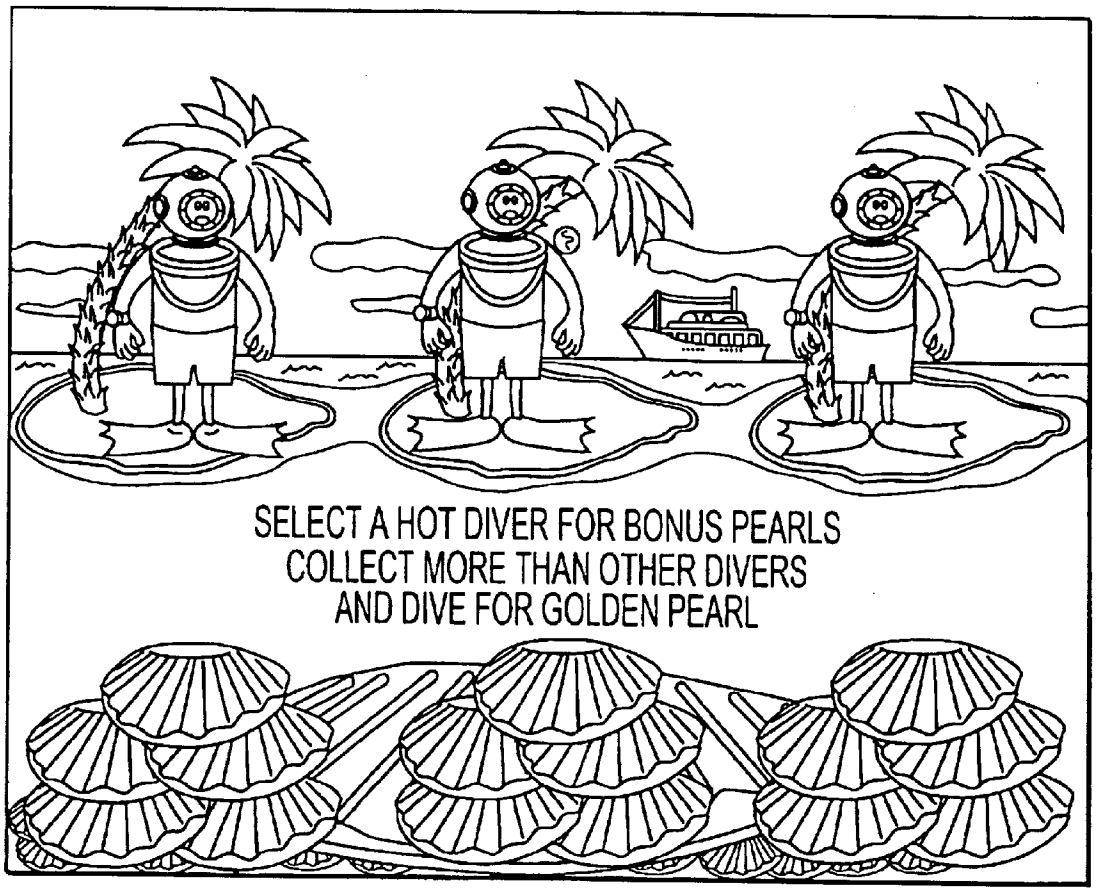
Figure 8O:
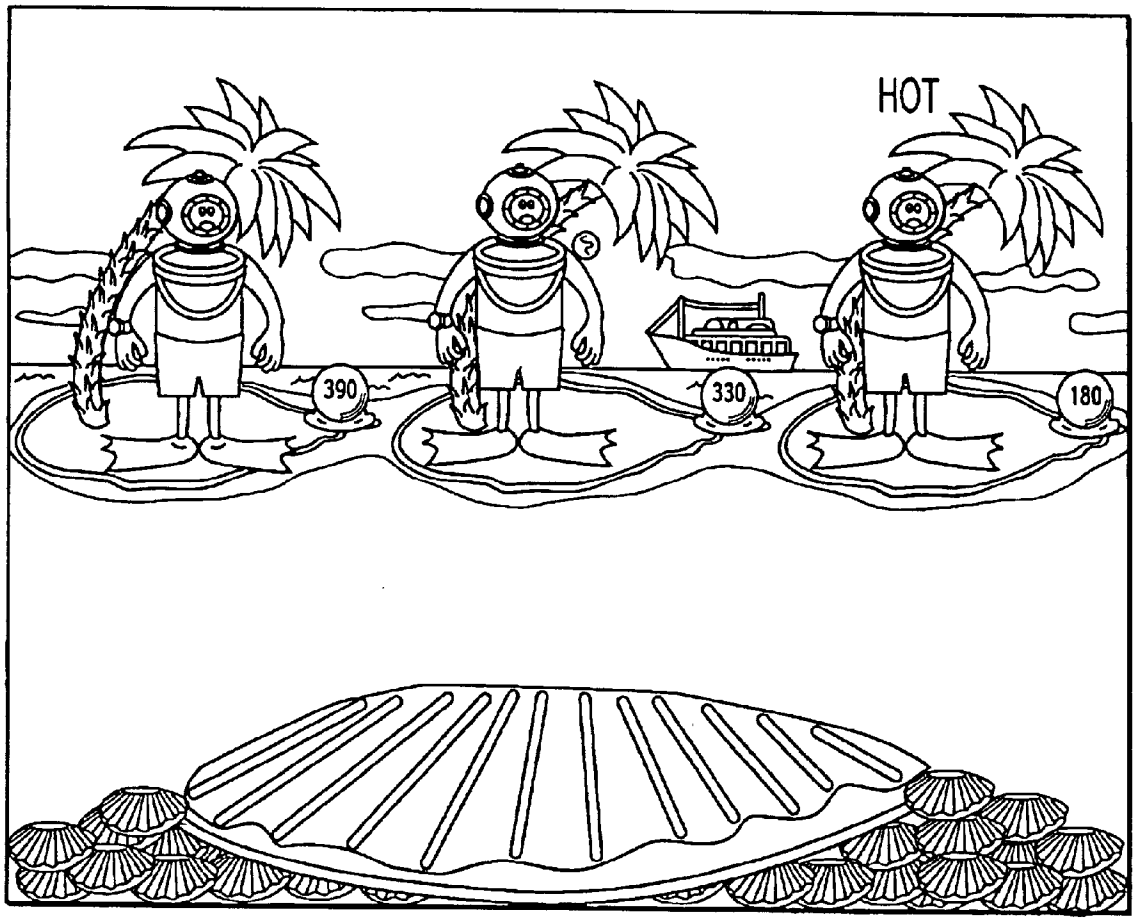
Figure 8P:
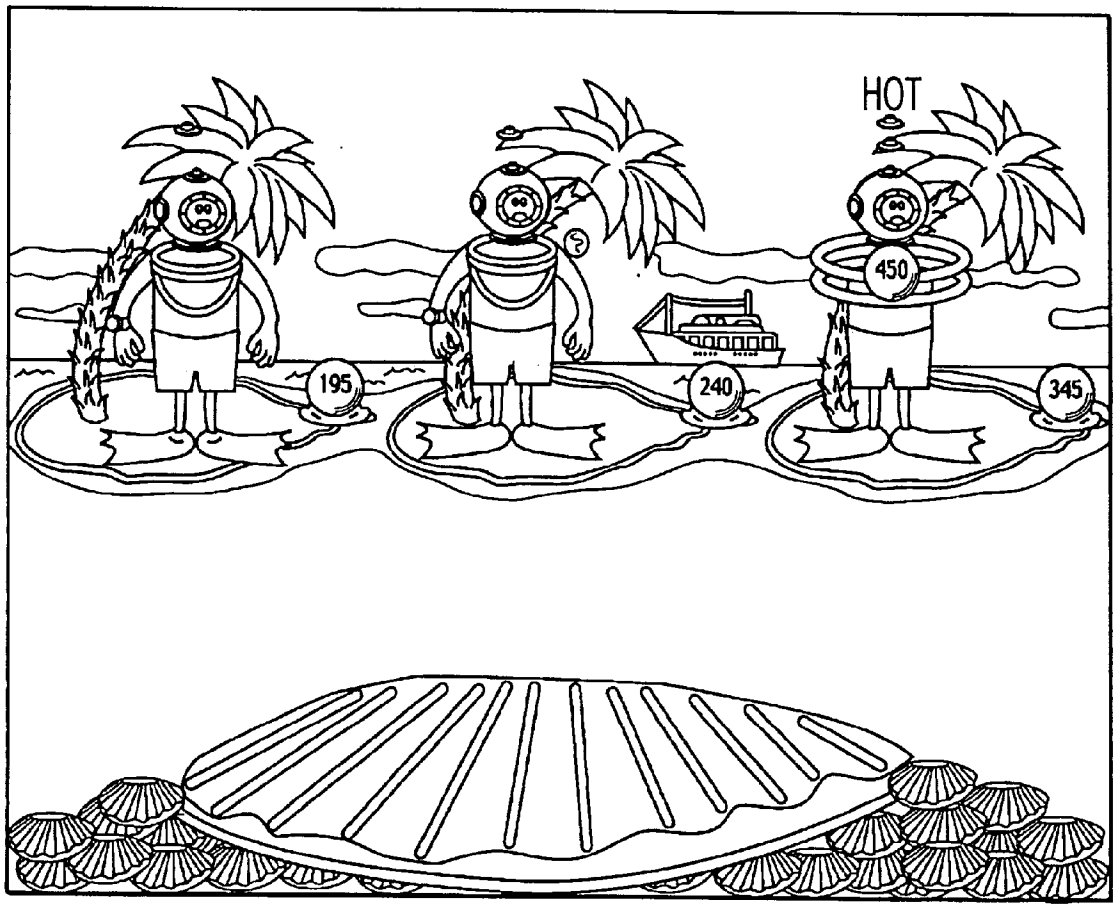

FIGS. 8*a*–8*p* are provided to illustrate the salient features of the present invention by way of representative screen displays that may appear during the course of a typical or exemplary game in accordance with one embodiment of the invention. It should be understood that many additional screen displays are possible during any particular game, and that the number is, in fact, virtually infinite. Nevertheless, the screen displays provided in FIGS. 8*a*–8*p* serve to illustrate the advantageous features associated with the present invention.

FIG. 8*a* shows an illustrative display at the start of a game. Note that the player has 388 credits, and has bet 3 lines at 4 credits per line for a total of 12 credits for the round.

Intuitive Pay—Pearl Dive Payout

FIG. 8*b* illustrates one aspect of the intuitive play feature of the present invention. As shown, the player has selected the first diver (i.e., spin position 712), who has won 30 credits as shown in row 1, column 1 of the display. When a pearl or other predetermined and/or pre-selected symbol appears in the column associated with a player-selected spin position, and a WILD symbol with helmet or other predetermined and/or pre-selected symbol appears anywhere on the display (row 2, column 4), the additional award is provided to the player. In this situation, because the player selected the first diver (i.e., spin position 712) and a pearl appears in the column associated with the first diver and a WILD symbol also appears within the display, the first diver dives down on the display and grabs the pearl in a symbolic fashion as finding a treasure, thereby enhancing the excitement to the player. Although 30 credits have been awarded here, it should be understood that any number of credits can be awarded. It is preferred that credits be awarded randomly within a predefined range of possible credits.

It should also be understood that the present invention, in any of the embodiments described herein, is not limited to where the bonus is awarded when the WILD appears anywhere on the screen and the pearl appears in the player selected column. For example, the present invention may alternatively award the player when the pearl and WILD symbol appear in the same player-selected column, or where the WILD symbol appears in the player selected column and the pearl appears elsewhere in the display. Similarly, the player-selected column may correspond to where a symbol or combination of symbols musts not appear. Alternatively, the present invention may use or utilize more than a pair of symbols, such as a combination of three symbols, four symbols, five symbols, and the like, as well as symbols other than the WILD symbol and/or pearl symbol.

Intuitive Pay—Contiguous Symbols on Payline Payouts

FIG. 8*c* illustrates that a payout is achieved for two contiguous pearls. Note that the player has selected five paylines, and that the two pearls appear on player-selected line 602. Preferably, in order to receive a payout for two contiguous pearls, the two pearls will be of the same color. However, pearls of different colors, or two contiguous symbols other than pearls may also be used.

FIG. 8*d* illustrates that the pearls can advantageously appear on "endposts" of the payline 604 and be considered contiguous. Note that 9 credits have been awarded. Similarly, FIG. 8*e* illustrates two contiguous pearls on an endpost portion of diagonal payline 610. Note that in FIG. 8*e* that if the player did not select diagonal payout line 610, he would not have received the 9 credits. That is, the player could have been awarded no credits (if neither payline 606 or 610 was selected), credits associated with payline 606 alone, credits associated with payline 610 alone, and/or credits associated with both paylines 606 and 610, depending on the player's selection of payline(s). FIG. 8*f* shows two contiguous pearls on the diagonal portion of payline 610.

FIG. 8*g* illustrates a three contiguous symbols on a player-selected payline 604, whereas FIG. 8*h* illustrates four contiguous symbols along player-selected payline 602. It is imperative to recognize that in order for the player to receive a payout for two or more predetermined symbols, the symbols, optionally predetermined or pre-selected, must appear on a player-selected payline. Thus, for example, in reference to FIG. 8*g*, if the player had selected only payline 602 and not the three paylines (602, 604 and 606) as shown by payline indicator 618, the player would not have received a bonus for the three contiguous seahorses that appear on payline 604.

FIG. 8*i* illustrates five contiguous symbols on a player-selected payline 610. Note that FIG. 8*i* also shows the two contiguous endpost pearls on payline 604, and that the player will also be awarded for the two contiguous endpost lobsters on payline 606. This screen display illustrates how a player can receive, for example, three payouts in a given round of the game.

Payline 602 in FIG. 8*j* illustrates the use of a WILD symbol in conjunction with a contiguous pearl. Also note the 300 credits awarded in column 1. Here, the WILD symbol serves a dual purpose. Specifically, the WILD symbol is used in conjunction with the pearl under the diver in column 1 to provide a spin position payout, and in conjunction with the contiguous pearl on payline 602 to provide a payline payout. FIG. 8*j* thus illustrates how the WILD symbol can be used to optionally award a player multiple payouts of different types in a given round of the game.

Random Pay—Two treasure Chests

FIG. 8*k* shows two treasure chests on the display. When two treasure chests appear on the display, in a preferred embodiment of the invention the player is provided a new display shown in FIG. 8*l*, where three treasure chests appear, each having award credits associated therewith. The player selects one of the three treasure chests to obtain his award credits. In FIG. 8*l*, the second treasure chest was selected, which provided 35 credits to the player.

Symbols other then treasure chests can optionally be used to invoke the bonus menu of FIG. 8*l*. Also, for example, more than two of the symbols may be required, or two of a first symbol and an additional symbol or symbols or combination of symbols may be used to invoke the menu shown in FIG. 8*l*. Similarly, FIG. 8*l* may provide any number of options for the player to choose from. For example, FIG. 8*l* could have thus provided the player with, say, two, four or five golden oysters.

Random Pay—Three Treasure Chests

FIG. 8*m* illustrates three treasure chests on the display. When three treasure chests appear on the display, the player, in a preferred embodiment of the invention, is provided a new display as shown in FIG. 8*n*, where three divers appear who will each dive for and collect five clams. Each of the five clams has a specific number of credits associated therewith. The diver with the most credits wins the competition.

Prior to diving, the player selects one of the three divers whom he believes will have the highest credit total from summing the credits associated with each diver's five pearls. For example, as shown in FIG. 8*o*, diver 1 was awarded 390 credits, diver 2 was awarded 330 credits, and diver 3 was awarded 180 credits. Other random pay competitions or awards may be used.

Optional Bonus Round Dive

FIG. 8*p* illustrates an additional bonus that may be provided to the player when the player selects the diver who collects the most credits while diving for the five clams. In this case, the player correctly selected diver 3 who collected 345 credits, whereas divers 1 and 2 collected 195 and 240 credits, respectively. Diver 3 thus collected an additional predetermined or randomly determined 450 credits from diving for the large clam shown at the bottom of the display.

Symbols other than treasure chests can be used to invoke the three divers shown in FIG. 8*n*. Also, for example, any number of the symbols may be used. Alternatively, two or three of a first symbol and an additional symbol or symbols may be used to invoke the menu shown in FIG. 8*n*. Similarly, FIG. 8*n* may provide any number of divers for the player to choose from. For example, FIG. 8*n* could have thus provided the player with the option to choose among two, four or five divers. Likewise, symbols other than divers may also be utilized in FIG. 8*n*.

General Purpose Computer and Computer-Readable Medium

Figure 9:
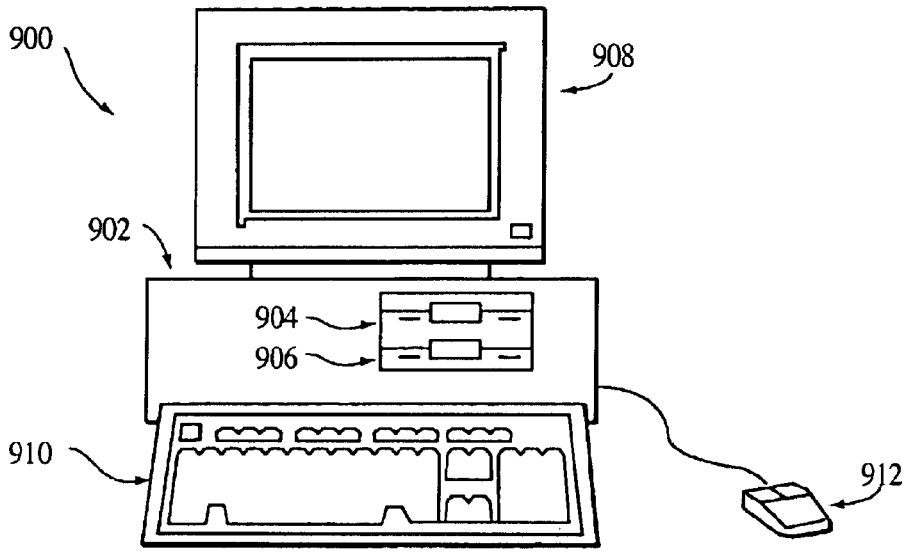
FIG. 9 illustrates one example of a central processing unit for implementing a computer process in accordance with a computer implemented stand-alone embodiment of the present invention.

The techniques of the present invention may be implemented on standard stand-alone casino gaming devices, as well as in a computing unit such as that depicted in FIG. 9. In this regard, FIG. 9 is an illustration of a main central processing unit which is also capable of implementing some or all of the computer processing in accordance with a computer implemented embodiment of the present invention. The procedures described herein are presented in terms of program procedures executed on, for example, a computer or network of computers.

Viewed externally in FIG. 9, a computer system designated by reference numeral 900 has a computer 902 having disk drives 904 and 906. Disk drive indications 904 and 906 are merely symbolic of a number of disk drives which might be accommodated by the computer system. Typically, these would include a floppy disk drive 904, a hard disk drive (not shown externally) and a CD ROM indicated by slot 906. The number and type of drives vary, typically with different computer configurations. Disk drives 904 and 906 are in fact optional, and for space considerations, are easily omitted from the computer system used in conjunction with the production process/apparatus described herein.

The computer system also has an optional display 908 upon which information, such as the screens illustrated in FIGS. 6–8, may be displayed. In some situations, a keyboard 910 and a mouse 912 are provided as input devices through which a player's actions may be inputted, thus allowing input to interface with the central processing unit 902. Then again, for enhanced portability, the keyboard 910 is either a limited function keyboard or omitted in its entirety. In addition, mouse 912 optionally is a touch pad control device, or a track ball device, or even omitted in its entirety as well, and similarly may be used to input a player's selections. In addition, the computer system may also optionally include at least one infrared transmitter and/or infrared received for either transmitting and/or receiving infrared signals. Instead of utilizing an infrared transmitter or infrared receiver, the computer system optionally uses a low power radio transmitter and/or a low power radio receiver. The low power radio transmitter transmits the signal for reception by components of the production process, and receives signals from the components via the low power radio receiver. The low power radio transmitter and/or receiver are standard devices in industry.

Although computer system 900 is illustrated having a single processor, a single hard disk drive and a single local memory, the system 900 is optionally suitably equipped with any multitude or combination of processors or storage devices. Computer system 900 is, in point of fact, able to be replaced by, or combined with, any suitable processing system operative in accordance with the principles of the present invention, including sophisticated calculators, and hand-held, laptop/notebook, mini, mainframe and super computers, as well as processing system network combinations of the same.

Figure 10:
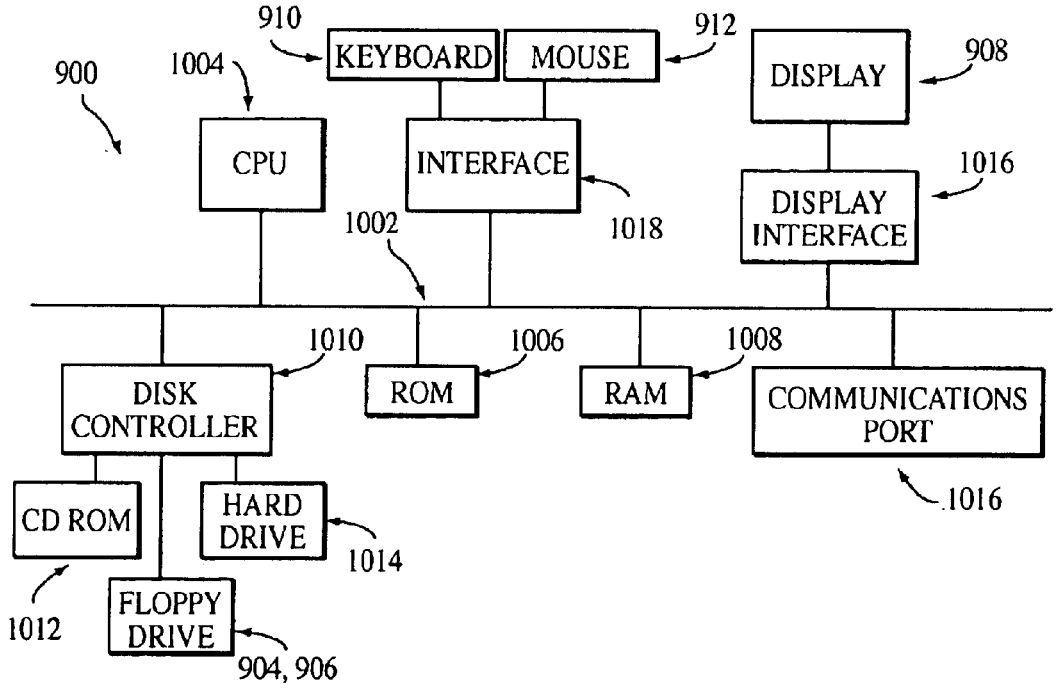
FIG. 10 illustrates one example of a block diagram of internal hardware of the central processing unit of FIG. 9.

FIG. 10 illustrates a block diagram of the internal hardware of the computer system 900 of FIG. 9. A bus 1002 serves as the main information highway interconnecting the other components of the computer system 900. CPU 1004 is the central processing unit of the system, performing calculations and logic operations required to execute a program. Read only memory (ROM) 1006 and random access memory (RAM) 1008 constitute the main memory of the computer. Disk controller 1010 interfaces one or more disk drives to the system bus 1002. These disk drives are, for example, floppy disk drives such as 904 or 906, or CD ROM or DVD (digital video disks) drive such as 1012, or internal or external hard drives 1014. As indicated previously, these various disk drives and disk controllers are optional devices.

A display interface 1017 interfaces display 908 and permits information from the bus 1002 to be displayed on the display 908. Again as indicated, display 908 is also an optional accessory. For example, display 908 could be substituted or omitted. Communications with external devices, for example, the other components of the system described herein, occur utilizing communication port 1016. For example, optical fibers and/or electrical cables and/or conductors and/or optical communication (e.g., infrared, and the like) and/or wireless communication (e.g., radio frequency (RF), and the like) can be used as the transport medium between the external devices and communication port 1016. Peripheral interface 1018 interfaces the keyboard 910 and the mouse 912, permitting input data to be transmitted to the bus 1002.

Conventional processing system architecture is more fully discussed in *Computer Organization and Architecture*, by William Stallings, MacMillan Publishing Co. (3rd ed. 1993); conventional processing system network design is more fully discussed in *Data Network Design*, by Darren L. Spohn, McGraw-Hill, Inc. (1993), and conventional data communications are more fully discussed in *Data Communications Principles*, by R. D. Gitlin, J. F. Hayes and S. B. Weinstain, Plenum Press (1992) and in *The Irwin Handbook of Telecommunications*, by James Harry Green, Irwin Professional Publishing (2nd ed. 1992). Each of the foregoing publications is incorporated herein by reference. Alternatively, the hardware configuration is, for example, arranged according to the multiple instruction multiple data (MIMD) multiprocessor format for additional computing efficiency. The details of this form of computer architecture are disclosed in greater detail in, for example, U.S. Pat. No. 5,163,131; Boxer, A., Where Buses Cannot Go, IEEE Spectrum, February 1995, pp. 41–45; and Barroso, L. A. et al., RPM: A Rapid Prototyping Engine for Multiprocessor Systems, IEEE Computer February 1995, pp. 26–34, all of which are incorporated herein by reference.

In alternate preferred embodiments, the above-identified processor, and, in particular, CPU 1004, may be replaced by or combined with any other suitable processing circuits, including programmable logic devices, such as PALs (programmable array logic) and PLAs (programmable logic arrays). DSPs (digital signal processors), FPGAs (field programmable gate arrays), ASICs (application specific integrated circuits), VLSIs (very large scale integrated circuits) or the like.

Figure 11:
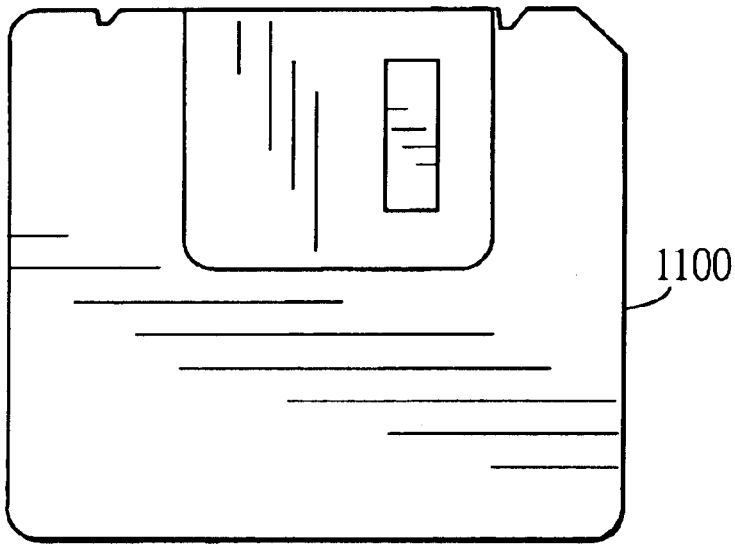
FIG. 11 illustrates one example of a memory medium which may be used for storing a computer implemented process of the present invention.

FIG. 11 is an illustration of an exemplary memory medium 1100 which can be used with disk drives illustrated in FIGS. 9 and 10. Typically, memory media such as floppy disks, or a CD ROM, or a digital video disk will contain, for example, a multi-byte locale for a single byte language and the program information for controlling the computer to enable the computer to perform the functions described herein. Alternatively, ROM 1006 and/or RAM 1008 illustrated in FIGS. 9 and 10 can also be used to store the program information that is used to instruct the central processing unit 1004 to perform the operations associated with the production process.

Figure 12:
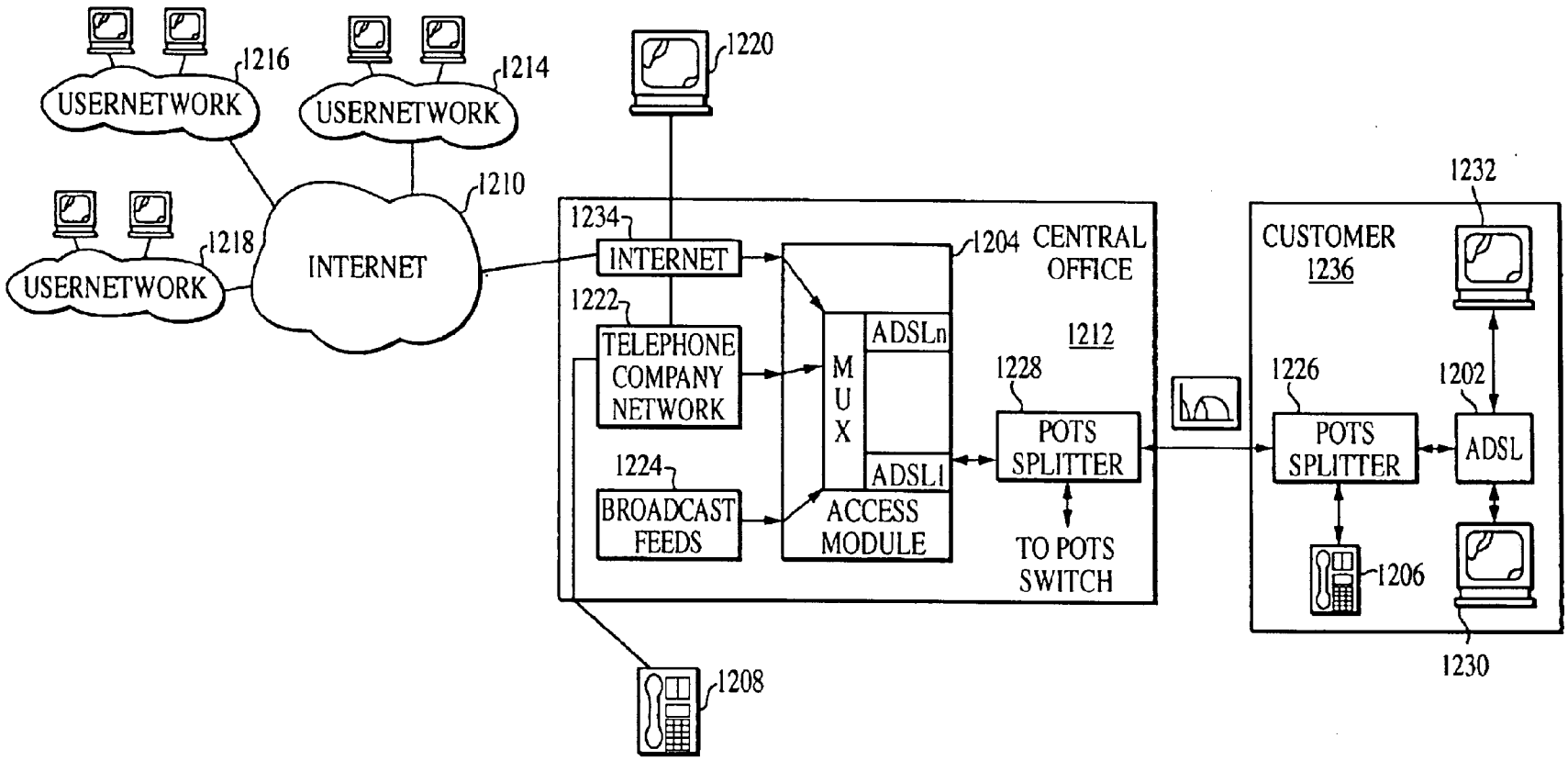
FIG. 12 illustrates an example of a combined Internet, POTS, and ADSL architecture which may be used with the present invention.

FIG. 12 is an illustration of the architecture of the combined Internet, POTS (plain, old, telephone service), and ADSL (asymmetric, digital, subscriber line) for use in accordance with the principles of the present invention. Furthermore, it is to be understood that the use of the Internet, ADSL, and POTS are for exemplary reasons only and that any suitable communications network may be substituted without departing from the principles of the present invention. This particular example is briefly discussed below.

In FIG. 12, to preserve POTS and to prevent a fault in the ADSL equipment 1202, 1204 from compromising analog voice traffic 1206, 1208 the voice part of the spectrum (the lowest 4 kHz) is separated from the rest by a passive filter, called a POTS splitter 1226, 1228. The rest of the available bandwidth, from about 10 kHz to 1 MHz, carries data at rates up to 6 bits per second for every hertz of bandwidth from data equipment 1230, 1232, and 1220. The ADSL equipment 1222 then has access to a number of destinations including significantly the Internet 1210, and other destinations 1222, 1224, 1234.

To exploit the higher frequencies, ADSL makes use of advanced modulation techniques, of which the best known is the discrete multitone (DMT) technology. As its name implies, ADSL transmits data asymmetrically (i.e., at different rates upstream toward the central office 1212 and downstream toward the subscriber 1236).

Cable television providers are providing analogous Internet service to PC players over their TV cable systems by means of special cable modems. Such modems are capable of transmitting up to 30 Mb/s over hybrid fiber/coax system, which use fiber to bring signals to a neighborhood and coax to distribute it to individual subscribers.

Cable modems come in many forms. Most create a downstream data stream out of one of the 6-MHz TV channels that occupy spectrum above 50 MHz (and more likely 550 MHz) and carve an upstream channel out of the 5–50-MHz band, which is currently unused. Using 64-state quadrature amplitude modulation (64 QAM), a downstream channel can realistically transmit about 30 Mb/s (the oft-quoted lower speed of 10 Mb/s refers to PC rates associated with Ethernet connections). Upstream rates differ considerably from vendor to vendor, but good hybrid fiber/coax systems can deliver upstream speeds of a few megabits per second. Thus, like ADSL, cable modems transmit much more information downstream than upstream. Then Internet architecture 1210 and ADSL architecture 1202, 1204 may also be combined with, for example, player networks 914, 916, and 918.

In accordance with the principles of the present invention, in one example, a main game server implementing the process of the invention may be located on one computing node or terminal (e.g., on player network 1214, or system 1220). Then, various players may interface with the main game server via, for instance, the ADSL equipment discussed above, and play the game from remotely located PCs. In this manner, a game owner may be able to attract players located at other parts of the country or planet.

Furthermore, the game according to the present invention may also be implemented manually. For instance, it is possible to play the game of the present invention as a standard slot machine or a mechanical slot machine having an expanded display area are previously discussed herein.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. While the foregoing invention has been described in detail by way of illustration and example of preferred embodiments, numerous modifications, substitutions, and alterations are possible without departing from the scope of the invention defined in the following claims.

Having thus described our invention, what we claim as new and desire to secure by Letters Patent is as follows:

1. A method for playing a slot machine using two or more spin buttons to issue awards based upon a selection of the spin buttons, as follows:

(A) a symbol matrix formed by a plurality of columns intersecting with a plurality of rows;

(B) the plurality of columns and rows defining a plurality of symbol positions;

(C) assigning one or more symbol positions in the symbol matrix to a spin button;

(D) placing a wager to participate in a game;

(E) randomly rearranging the plurality of symbols in the symbol matrix upon the selection of a spin button;

(F) displaying the rearranged symbols; and (G) issuing awards based upon the following combinations of symbols:

(1) one or more pre-determined symbols in any symbol position not assigned to the selected spin button; and (2) the appearance of exactly one pre-determined symbol in any of the symbol positions assigned to the selected spin button.

2. A method of claim 1 in which the awards issue based upon the selection of one of three spin buttons.

3. A method of claim 1(A) in which the symbol matrix is formed by five columns intersecting three rows.

4. A method of claim 1(B) in which five columns intersecting three rows define fifteen symbol positions.

5. A method of claim 1(C) in which each of three spin buttons are assigned the symbol positions in the symbol matrix formed by five columns intersecting three rows and defining fifteen symbol positions, as follows:

A) all three symbol positions in a first column are assigned to the first spin button;

B) all three symbol positions in a third column are assigned to the second spin button;

C) all three symbol positions in a fifth column are assigned to the third spin button.

6. A method of claim 1(C) in which none of the spin buttons are assigned the symbol positions that exactly overlap the symbol positions of an available pay line.

7. A method of claim 1(D) in which a player determines the wager without regard for a number of the spin buttons or the symbol positions assigned to each spin button.

8. A method of claim 1(D) in which a player determines the wager by activating pay lines and sets amounts to bet on each of active pay lines, without regard for a number of the spin buttons or the symbol positions assigned to each spin button.

9. A method of claim 1(E) in which the selection of the spin button results in the same random rearrangement of the symbols in the symbol matrix.

10. A method of claim 1(E) in which the selection of the spin button results in a different random rearrangement of the symbols in the symbol matrix.

11. A method of claim 1(F) in which the rearranged symbols are displayed in a manner that indicates the symbol positions assigned to the selected spin button.

12. A method of claim 1(F) in which the rearranged symbols are displayed in the symbol matrix along with an animated character positioned above the symbol positions assigned to the selected spin button.

13. A method of claim 1(G) in which the awards issue based upon the following combination of symbols:

(A) one or more pre-determined symbols in any of the symbol positions not assigned to the selected spin button; and (B) exactly one pre-determined symbol in any of the symbol positions assigned to the selected spin button.

14. A method of claim 1(G) in which the awards issue based upon the following combination of symbols:

(A) one or more pre-determined symbols in any of the symbol positions not assigned to the selected spin button; and (B) exactly one pre-determined symbol in any of the symbol positions assigned to the selected spin button, without regard to the location of the symbol relative to other symbols or other symbol positions.

15. A method of claim 1(G) in which the awards issue based upon at least one of the following combination of symbols:

(A) one or more predetermined symbols in any of the symbol positions not assigned to the selected spin button and exactly one pre-determined symbol in any of the symbol positions assigned to the selected spin button; or (B) a pre-determined combination of symbols in contiguous symbol positions on a pay line.

16. A method of claim 1(G) in which the awards are calculated by randomly selecting a value from a pre-determined range of values and then multiplying the selected value by an amount of the total wager.

17. A method for playing a slot machine using three spin buttons to issue awards based upon a selection of one of the three spin buttons, as follows:

(A) a symbol matrix formed by five columns intersecting three rows;

(B) the five columns and three rows defining fifteen symbol positions;

(C) assigning each of the three spin buttons the following symbol positions:

(1) all three symbol positions in the first column are assigned to the first spin button;

(2) all three symbol positions in the third column are assigned to the second spin button;

(3) all three symbol positions in the fifth column are assigned to the third spin button;

(D) placing a wager to participate in a game, with said wager determined by a player without regard for a number of the spin buttons or the symbol positions assigned to each spin button;

(E) randomly rearranging a plurality of symbols in the symbol matrix upon selection of one of the three spin buttons, with any spin button selection resulting in the same random rearrangement of symbols in the symbol matrix;

(F) displaying the rearranged symbols in the symbol matrix along with an animated character positioned above the column of symbol positions assigned to the selected spin button; and (G) issuing awards based upon the following combinations of the symbols:

(1) one or more predetermined symbols in any of the symbol positions not assigned to the selected spin button; and (2) exactly one pre-determined symbol in any of the symbol positions assigned to the selected spin button, without regard to the location of the symbol relative to other symbols or other symbol positions;

(H) calculating the awards by randomly selecting a value from a pre-determined range and then multiplying the selected value by an amount of the total wager.

18. A method for playing a slot machine using three spin buttons to issue awards based upon a selection of one of the three spin buttons, as follows:

(A) a symbol matrix formed by five columns intersecting three rows;

(B) the five columns and three rows defining fifteen symbol positions;

(C) the fifteen symbol positions defining one or more pay lines with each pay line containing at least one symbol position in each of the columns or each pay line containing at least one symbol in each of the rows;

(D) assigning each of the three spin buttons symbol positions, such that none of the spin buttons are assigned symbol positions that exactly overlap the symbol positions of an available pay line;

(E) placing a wager to participate in a game, with said wager determined by a player's activating pay lines and setting amounts to bet on each of the active pay lines, without regard for a number of the spin buttons or the symbol positions assigned to each spin button;

(F) randomly rearranging the plurality of symbols in the symbol matrix upon the selection of one of the three spin buttons, with any spin button selection resulting in the same random rearrangement of the symbols in the symbol matrix;

(G) displaying the rearranged symbols in the symbol matrix along with an animated character positioned above the column of the symbol positions assigned to the selected spin button;

(H) issuing awards based upon the following combinations of the symbols:

(1) one or more pre-determined symbols in any symbol position not assigned to the selected spin button and exactly one pre-determined symbol in any of the symbol positions assigned to the selected spin button; or (2) the appearance of a pre-determined combination of the symbols in contiguous symbol positions on an active pay line;

(I) calculating awards for (H)(1) by randomly selecting a value from a pre-determined range and then multiplying the selected value by an amount of the total wager;

(J) calculating awards for (H)(2) according to a pre-determined pay schedule and the amount wagered on the active pay line.

* * * * *